US009625097B2

(12) United States Patent
Bayliff et al.

(10) Patent No.: US 9,625,097 B2
(45) **Date of Patent: *Apr. 18, 2017**

(54) METHODS AND SYSTEMS FOR REDUCING PRESSURE OF NATURAL GAS AND METHODS AND SYSTEMS OF DELIVERING NATURAL GAS

(71) Applicant: QUESTAR GAS COMPANY, Salt Lake City, UT (US)

(72) Inventors: Todd Allan Bayliff, Salt Lake City, UT (US); Troy David Sorensen, Bluffdale, UT (US); Michael Lowell Gill, Midvale, UT (US); Richard Joseph Kiser, II, Salt Lake City, UT (US); Kelly D. Pace, Kaysville, UT (US); Lee R. Mettmann, West Jordan, UT (US)

(73) Assignee: Questar Gas Company, Salt Lake City, UT (US)

( * ) Notice: Subject to any disclaimer, the term of this patent is extended or adjusted under 35 U.S.C. 154(b) by 154 days.

This patent is subject to a terminal disclaimer.

(21) Appl. No.: 14/486,910

(22) Filed: Sep. 15, 2014

(65) Prior Publication Data

US 2015/0000757 A1 Jan. 1, 2015

Related U.S. Application Data

(63) Continuation of application No. 12/877,542, filed on Sep. 8, 2010, now Pat. No. 8,833,088, which is a (Continued)

(51) Int. Cl.
*F17C 7/00* (2006.01)

(52) U.S. Cl.
CPC ..... *F17C 7/00* (2013.01); *F17C 2201/0104* (2013.01); *F17C 2201/056* (2013.01); (Continued)

(58) Field of Classification Search
CPC F17C 7/00; F17C 2225/035; F17C 2227/036; F17C 2260/032; F17C 2270/05; (Continued)

(56) References Cited

U.S. PATENT DOCUMENTS 2,522,787 A * 9/1950 Hughes ..... F25J 1/0202 62/5
3,733,838 A * 5/1973 Delahunty ..... F25J 1/0025 62/48.2

(Continued)

FOREIGN PATENT DOCUMENTS

DE 10218678 A1 * 11/2002

*Primary Examiner* — Emmanuel Duke
(74) *Attorney, Agent, or Firm* — McGuireWoods LLP

(57) ABSTRACT

Methods and systems for reducing a pressure of compressed natural gas and for delivering natural gas are disclosed. A regulator comprising a vortex tube may be used to reduce the pressure of compressed natural gas while a temperature thereof is also reduced. The temperature reduction associated with a pressure drop in the compressed natural gas is achieved by throttling the gas at constant enthalpy from 3,000 psig to 150 psig through the regulator. At least one heat exchanger may be utilized to increase the temperature of the compressed natural gas to a temperature suitable for injection delivery. A pressure-reducing regulator may be used to further reduce a pressure of the gas to about 45 psig for delivery to an end-user.

27 Claims, 12 Drawing Sheets

Related U.S. Application Data continuation of application No. 12/555,575, filed on Sep. 8, 2009, now Pat. No. 8,613,201.

(52) U.S. Cl.
CPC ..... *F17C 2203/0639* (2013.01); *F17C 2205/0107* (2013.01); *F17C 2205/0142* (2013.01); *F17C 2205/0157* (2013.01); *F17C 2205/0332* (2013.01); *F17C 2205/0338* (2013.01); *F17C 2221/033* (2013.01); *F17C 2223/0123* (2013.01); *F17C 2223/036* (2013.01); *F17C 2225/0123* (2013.01); *F17C 2225/035* (2013.01); *F17C 2227/036* (2013.01); *F17C 2227/0388* (2013.01); *F17C 2250/032* (2013.01); *F17C 2250/043* (2013.01); *F17C 2250/0439* (2013.01); *F17C 2250/0626* (2013.01); *F17C 2250/0636* (2013.01); *F17C 2260/032* (2013.01); *F17C 2270/05* (2013.01); *F17C 2270/07* (2013.01); *Y10T 137/0396* (2015.04); *Y10T 137/3802* (2015.04); *Y10T 137/6416* (2015.04); *Y10T 137/7837* (2015.04); *Y10T 137/7904* (2015.04); *Y10T 137/8593* (2015.04)

(58) Field of Classification Search
CPC ..... F17C 2270/07; F17C 2205/0107; F17C 2205/0142; F17C 2205/0157; F17C 2227/0388; Y01T 137/6416; Y10T 137/3802; Y10T 137/7904
See application file for complete search history.

(56) References Cited

U.S. PATENT DOCUMENTS

| | | | | | |
|---|---|---|---|---|---|
| 3,815,375 | A * | 6/1974 | Inglis | B01D 53/26 | 55/315.1 |
| 4,646,524 | A * | 3/1987 | Kawashima | F25B 9/04 | 62/402 |
| 5,386,699 | A * | 2/1995 | Myers | F25J 1/0022 | 123/525 |
| 5,582,012 | A * | 12/1996 | Tunkel | F25B 9/04 | 62/5 |
| 5,606,858 | A * | 3/1997 | Amir | F02C 1/00 | 60/648 |
| 5,682,749 | A * | 11/1997 | Bristow | F25B 9/04 | 62/5 |
| 5,911,740 | A * | 6/1999 | Tunkel | F25B 9/04 | 62/401 |
| 6,141,973 | A * | 11/2000 | Whitmore | F25B 9/02 | 62/50.1 |
| 6,932,858 | B2 * | 8/2005 | Nicol | B01D 3/14 | 55/315 |
| 6,948,323 | B2 * | 9/2005 | Matheoud | F17C 5/02 | 141/82 |
| 8,613,201 | B2 | 12/2013 | Bayliff et al. | | |
| 8,833,088 | B2 | 9/2014 | Bayliff et al. | | |
| 2002/0170297 | A1 * | 11/2002 | Quine | F17C 7/04 | 62/50.2 |
| 2007/0261415 | A1 | 11/2007 | Barnes | | |
| 2011/0056571 | A1 | 3/2011 | Bayliff et al. | | |

* cited by examiner

METHODS AND SYSTEMS FOR REDUCING PRESSURE OF NATURAL GAS AND METHODS AND SYSTEMS OF DELIVERING NATURAL GAS

CROSS-REFERENCE TO RELATED APPLICATIONS

This application is a continuation of U.S. patent application Ser. No. 12/877,542, filed Sep. 8, 2010, now U.S. Pat. No. 8,833,088, issued Sep. 16, 2014, titled METHODS AND SYSTEMS FOR REDUCING PRESSURE OF NATURAL GAS AND METHODS AND SYSTEMS OF DELIVERING NATURAL GAS, which is a continuation of U.S. patent application Ser. No. 12/555,575, filed Sep. 8, 2009, now U.S. Pat. No. 8,613,201, issued Dec. 24, 2013, titled METHODS AND SYSTEMS FOR REDUCING PRESSURE OF NATURAL GAS AND METHODS AND SYSTEMS OF DELIVERING NATURAL GAS, all of which are incorporated herein by reference in their entireties.

BACKGROUND OF THE INVENTION

1. Field of the Invention

Embodiments of the invention generally relate to methods and systems for reducing pressure of natural gas and, in particular, to methods and systems for injection delivery of compressed natural gas.

2. Background

It is a well-known practice to compress non-ideal gases, including elemental and other gases for scientific or industrial purposes, for transport and delivery to consumers or other customers. For example, it is a known practice to transport compressed natural gas (CNG) by truck, ship, or similar delivery system to users that periodically require natural gas supply in excess of the supply available through existing pipelines. Further, there are areas in which natural gas service via pipeline is not available at all, due to remoteness, the high cost of laying pipelines, planned or unplanned outages, or other factors. In such cases, tanks of CNG transported by truck, for example, can be an economical way to provide the natural gas service required by such users.

To be economical, such tanks must be filled with large amounts of usable natural gas. Accordingly, full tanks of CNG are under very high pressure, commonly around 3000 pounds per square inch gauge (psig). However, in many cases natural gas under considerably lower pressure, e.g., from 20 psig to 100 psig, is required. Consequently, unloading a CNG tank requires a substantial reduction in the gas pressure prior to being received at a customer's intake. Currently, reducing the pressure of the CNG may be problematic due to substantial cooling of the natural gas caused by the Joules-Kelvin effect. Allowing a large volume of CNG to be depressurized results in a large temperature drop that can expose the material that comprises CNG tanks, valves, pipelines (particularly carbon steel pipes), customer equipment or other pieces of a natural gas system to low temperatures possibly exceeding safe operating ranges specified by manufacturers and codes.

Users of CNG supply systems may require volumes of natural gas that range from very low flow to flows in excess of 25,500 standard cubic feet per hour (scfh). At such rates, the cooling resulting from depressurization may be transmitted a significant distance downstream from the point of regulation. This may increase the chance of failure if the material or equipment at the customer's intake is not rated for the extreme cold temperature of the gas. Such failures could result in a loss of a substantial volume of gas through a relief valve that releases gas to the atmosphere when pressure is too high. At worst, a failure could result in irreparable damage or destruction of equipment and/or explosion.

It is understood that there are electric or electronic devices, control valves, and/or pressure controllers that may be able to accept the high-pressure CNG, depressurize it, and pass it to a standard natural gas intake at a relatively high rate of delivery. Such devices are extremely expensive, however, reducing or eliminating the profitability of truck-delivery of CNG. Further, devices capable of operating at the temperature ranges produced by extreme depressurization of natural gas are not readily available.

Accordingly, there is a need in the industry for a reliable natural gas delivery system that provides depressurized gas at a steady rate with varying flow conditions.

BRIEF SUMMARY OF THE INVENTION

In some embodiments, the present invention includes a system for reducing a pressure of a gas. The system may include at least one vortex regulator, a heat exchange device and a pressure-reducing regulator. The at least one vortex regulator may include a vortex tube and may have at least one inlet to receive natural gas and at least one outlet for releasing the natural gas at a substantially decreased pressure and temperature. The heat exchange device may be configured to receive the natural gas from the at least one vortex regulator and to increase the temperature of the natural gas. The pressure-reducing regulator may be in fluid communication with the heat exchange device and may be configured for further reducing the pressure of the natural gas.

In additional embodiments, the present invention includes a method of reducing a pressure of natural gas that includes directing a natural gas stream into at least one vortex regulator comprising a vortex tube, reducing a pressure and a temperature of the natural gas stream using the at least one vortex regulator, heating the natural gas stream from the at least one vortex regulator using a heat exchanger in fluid communication with the vortex regulator and directing the natural gas stream from the heat exchanger to a pressure-reducing regulator to further reduce the pressure thereof.

In further embodiments, the present invention includes a method of delivering natural gas. The method may include directing a natural gas stream from at least one storage vessel to at least one vortex regulator comprising a vortex tube, decreasing a pressure of the natural gas stream while simultaneously reducing a temperature of the gas using the at least one vortex regulator and directing the natural gas stream to a heat exchanger having a surface in communication with a fluid having a temperature higher than that of the natural gas stream to heat the gas.

In yet another embodiment, the present invention may include a system for delivering natural gas that includes a mobile support. The system may include at least one storage vessel for containing the natural gas in a compressed form disposed on the mobile support and a vortex regulator including at least one vortex tube and disposed on the mobile support. The vortex regulator may be in fluid communication with the at least one storage vessel and a heat exchanger.

The heat exchanger may be configured for exchanging heat between the natural gas and ambient air.

BRIEF DESCRIPTION OF THE DRAWINGS

While the specification concludes with claims particularly pointing out and distinctly claiming that which is regarded as embodiments of the present invention, the advantages of this invention may be more readily ascertained from the following description of the invention when read in conjunction with the accompanying drawings in which:

DETAILED DESCRIPTION OF THE PREFERRED EMBODIMENTS

The illustrations presented herein are not meant to be actual views of any particular material, apparatus, system, or method, but are merely idealized representations that are employed to describe embodiments of the present invention. Additionally, elements common between figures may retain the same numerical designation for convenience and clarity.

As used herein, the terms "compressed natural gas" and "CNG" mean and include natural gas, primarily methane, compressed under high pressure which may be stored, for example, in specially designed storage tanks at from about 2,000 psig to about 3,600 psig.

The term "disposed on," as used herein, means and includes mounted on, placed on, positioned on, supported by, attached to, or otherwise connected to a mobile support, either directly or indirectly.

The phrase "in fluid communication," as used herein, means to engage in, or currently be available for, one-way or two-way movement of a liquid, gas, or both, as circumstances indicate. Fluid communication between two elements may be direct between the two elements (e.g., when the two elements are physically contacting each other in a functional manner) or indirect (i.e., when the two elements are not physically contacting each other but are connected in a functional manner via an intermediary element(s) such as a transferring means).

The phrase "in selective fluid communication," as used herein, means that one of the two elements is ready for being placed in fluid communication with the other of the two elements, e.g., the one element would be in fluid communication with the other element if the two elements were connected, directly or indirectly, to each other as previously described.

The terms "Joule-Thomson effect(s)" and "Joule-Kelvin effect(s)," as used herein, mean and include the temperature change of a gas or a liquid when forced through a valve, a narrow jet, or a porous plug adiabatically (i.e., without loss or gain of heat to the system). The rate of change of temperature T with respect to pressure P in a Joule-Thomson process (that is, at constant enthalpy H) is the Joule-Thomson (Kelvin) coefficient μJT. This coefficient can be expressed in terms of the gas's volume V, its heat capacity at constant pressure Cp, and its coefficient of thermal expansion α as:

$$\mu_{JT} = \left(\frac{\partial T}{\partial P}\right)_H = \frac{V}{C_p}(\propto T - 1)$$

As used herein, the term "pounds force per square inch gauge," or "psig," means and includes the pressure in pounds force per square inch exceeding atmospheric pressure.

Figure 1:
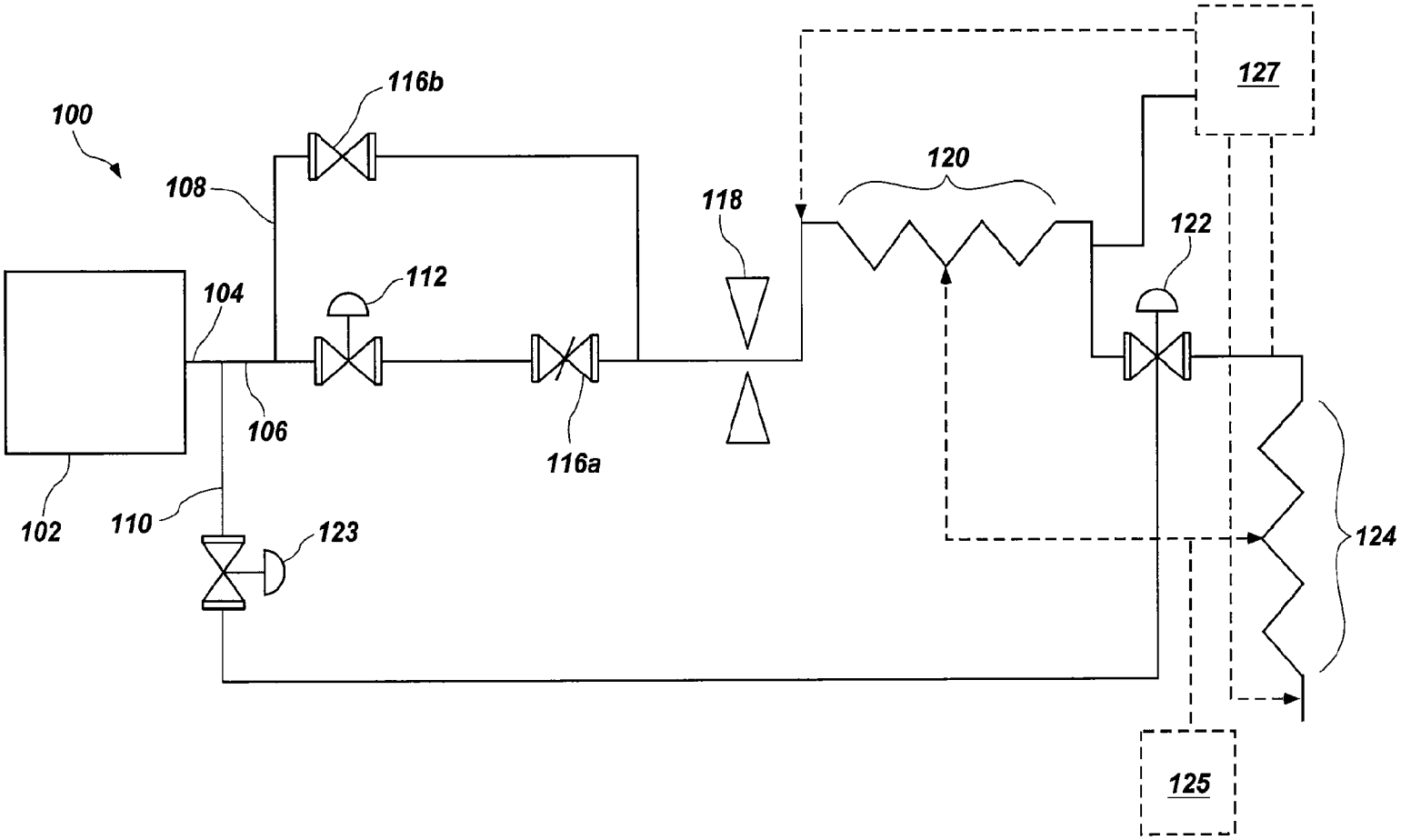
FIGS. 1-4 are simplified schematic diagrams illustrating embodiments of systems for reducing pressure of natural gas.

An embodiment of a system 100 for reducing a pressure of natural gas is shown in a simplified schematic view in FIG. 1. As shown in FIG. 1, the gas may be stored in a compressed form at least one storage vessel 102 and may be fed into the system 100 through a gas inlet 104. The gas may enter the system 100 from the storage vessel 102 at a pressure of from about 2,000 psig to about 4,000 psig and, more particularly, about 3,000 psig. The system 100 may be configured to reduce the pressure of the gas by from about 3,000 psig to pressures ranging from 1,500 psig to 2,500 psig and, more particularly, by as much as 2,500 psig. After entering the system 100, the gas may be fed through gas flow line 106 and may, optionally, be diverted to a bypass line 108 or a static pressure line 110, as will be described in further detail. A flow rate of the gas within the system 100 may be less than or equal to about 8,500 standard cubic feet per hour (scfh).

The gas may be directed though the gas flow line 106 to a first regulator 112 configured to substantially reduce the pressure of the gas. As a non-limiting example, the first regulator 112 may be a Joule-Thomson expansion valve, a diaphragm regulator or a needle valve regulator, such as those commercially available from Bryan Donkin RMG (Germany), Elster-Instromet A/S (Denmark) and Tescom-Emerson Process Management (Elk River, Minn.). The pressure of the gas may be reduced by the first regulator 112 such that the gas exiting the first regulator 112 has a pressure of from about 1,500 psig to about 2,500 psig at a location in the gas flow line 106.

The gas may be fed from the first regulator 112 to a vortex regulator 118 by way of a first valve 116*a*. Alternatively, a Venturi nozzle or any orifice, such as, a valve or a narrow jet, may be used instead of the vortex regulator 118. For example, the vortex regulator 118 may include a vortex tube, examples of which are disclosed in U.S. Pat. No. 2,907,174 to Hendel, U.S. Pat. Nos. 5,911,740 and 5,749,231 to Tunkel et al., and U.S. Pat. No. 6,071,424 to Tuszko et al., each of which is hereby incorporated by reference in its entirety. A vortex tube, often referred to as the Ranque vortex tube, the Hilsch tube and the Ranque-Hilsch tube, is a static mechanical device that takes pressurized compressible fluid and derives a hot fluid and a cold fluid at a lower pressure. The mechanics by which the vortex tube separates a fluid into hot and cold parts through depressurizing are largely unknown, but empirical data validate that it is a measurable, repeatable and sustainable event. In operation, the pressurized compressible fluid is injected through tangential nozzles into a chamber in which the compressible fluid is simultaneously separated into a fluid stream higher in temperature than the inlet stream and a fluid stream that is cooler than the inlet stream. While not wishing to be bound by any particular scientific theory, tangential injection may set the pressurized compressible fluid stream in a vortex motion. This spinning stream of compressible fluid may turn about 90° and pass down the hot tube in the form of a spinning shell or vortex, similar to a tornado. A valve at one end of the tube allows some of the warmed fluid to escape. That portion of the warmed fluid that does not escape is directed back down the tube as a second vortex inside the low-pressure area of the larger vortex. The inner vortex may lose heat to the larger vortex and exhaust through the other end as a cold fluid stream. The gas in the vortex is cooled because part of its total energy converts into kinetic energy.

By way of non-limiting example, the vortex regulator 118 may be configured to substantially reduce the pressure of the gas using a method such as that disclosed in U.S. Pat. No. 5,327,728 to Tunkel, which is hereby incorporated by reference in its entirety. Such a vortex regulator may be obtained from Universal Vortex, Inc. (Robbinsville, N.J.). The vortex regulator 118 is able to reduce the pressure of the gas from about 3,000 psig to about 150 psig for gas flows ranging from about 1,800 scfh to about 8,500 scfh without experiencing regulator freeze up. The vortex regulator 118 may produce a hot gas fraction during the pressure reduction process that is diverted onto surfaces of the vortex regulator 118 to prevent the formation of ice and mitigate the potential freeze up condition associated with high-pressure reduction. The pressure of the gas may be reduced by the vortex regulator 118 so that the gas exiting therefrom has a pressure of from about 300 psig to about 50 psig and, more particularly, about 150 psig. The first valve 116*a* may be, for example, a ball valve such as those commercially available from Swagelok Company (Solon, Ohio).

In some embodiments, where a volumetric flow demand of the gas may be sufficiently high, the gas may be diverted to the bypass line 108, which circumvents the first regulator 112. The gas may be fed through the bypass line 108 and back to the gas flow line 106 by a second valve 116*b*. After re-entering the gas flow line 106, the gas may be fed into the vortex regulator 118 at a pressure of from about 2,000 psig to about 4,000 psig and, more particularly, about 3,000 psig.

A temperature of the gas is substantially reduced during pressure reduction by the vortex regulator 118 and the first regulator 112. After exiting the vortex regulator 118, the temperature of the gas may be from about −78.9° C. (about −110° F.) to about −56.7° C. (about −70° F.) and, more particularly, about −67.8° C. (about −90° F.). The reduction in pressure is advantageous to the system 100 due to the significant temperature drop that occurs due to the Joule-Kelvin effect. The temperature reduction associated with the pressure reduction in the gas is achieved by throttling the gas at a constant enthalpy from through the vortex regulator 118 and the first regulator 112. The temperature gradient between the gas exiting the vortex regulator 118 and ambient air heater 120 enables for significant heat input into the system 100 via ambient heater 120. The ambient heater 120 may be a heat exchanger having a forced convection surface area, or any other device configured for exchanging heat between gas and ambient air. The ambient heater 120 may be in fluid communication with the vortex regulator 118 and a surface of the ambient heater 120 may be in communication with the ambient air for transfer of heat from the ambient air to the gas. The system 100 may further include a fan (not shown) or other device for circulating the ambient air over the surface of the ambient heater 120. Energy transferred from the surrounding environment (i.e., ambient air) into the system 100 at a high rate through a convection process via the ambient heaters 120 and 124 may be determined using the following equation:

$$Q=H(\Delta T),$$

Wherein the variable H is the convection coefficient and is dependent on the gas and geometry of the device it is flowing through. The reduced temperature of the gas resulting from the pressure reduction by the vortex regulator 118 and the first regulator 112 creates a large temperature gradient (ΔT) between the gas and the ambient air. The energy transfer direction (Q) should increase based on the available energy in the ambient environment. Typically, the sign of the temperature gradient (ΔT) predicts the direction of energy transfer. Therefore, if the temperature of the gas is less than that of the surroundings, energy is transferred into the system.

By achieving a large temperature gradient from a rapid two-stage pressure reduction, with the primary pressure reduction occurring in the vortex regulator 118, gas heating may be achieved efficiently. The large temperature gradient achieved through pressure reduction by the vortex regulator 118 enables a substantial portion of the heating process to take place in the ambient heater 120.

The ambient heater 120 may be modeled by using a closed loop energy balance that encompasses the working fluids (i.e., natural gas) and ambient air. The fundamental equation that describes the required heat input for the heat transfer process associated with the ambient heater 120 is as follows:

$$Q=UA\Delta Tm,$$

wherein Q is an overall heat transfer, U is the heat transfer coefficient for the ambient heater, ΔTm is a log mean temperature difference between the gas and the ambient air and A is an overall heat transfer area of the ambient heater 120. By way of non-limiting example, the ambient heater 120 may have a heat transfer coefficient (U) of from about 0.75 to about 1.2 and, more particularly, about 0.965 and a heat transfer area (A) of from about 50 ft3 to about 400 ft3 and, more particularly, about 214.63 ft3.

For example, if the temperature of the ambient air is about 10° C. (50° F.) and the temperature of the gas is about −67.8° C. (−90° F.), the gas may be heated to ambient temperature (i.e., about 10° C.) using about 11,986 BTUs. In some embodiments, an external heat source may be supplied to the ambient heater 120 to increase the efficiency of heating.

The gas exiting the ambient heater 120 may have a temperature of from about 0° C. to about 20° C. (about 68° F.) and, more particularly, about 10° C. (about 50° F.). The gas may be directed from the ambient heater 120 to a second regulator 122 configured to substantially reduce the pressure of the gas. Additionally, the gas, or a portion thereof, may be directed from the gas inlet 104 to the static pressure line 110.

The static pressure line 110 may maintain a constant pressure, the purpose of which is to control an outlet pressure of the second regulator 122. Gas may be directed through the static pressure line 110 by a gas loaded regulator valve 123, such as a diaphragm regulator described herein.

The second regulator 122 may be a Joule-Thomson expansion valve, a diaphragm regulator, or a needle valve regulator such as, for example, a 26-1200 series high flow regulator, which is commercially available from Tescom-Emerson Process Management. The second regulator 122 may control the pressure of the gas to enable for a large flow differential while substantially reducing or eliminating pressure spikes and ensuing incremental flow changes. As a non-limiting example, the second regulator 122 may reduce the pressure of the gas to from about 20 psig to about 100 psig and, more particularly, about 45 psig.

The gas may then be directed to another ambient heater 124 configured to increase the temperature of the gas within about 28.9° C. (about 20° F.) of an ambient temperature, such as, from about 28.9° C. (about 20° F.) to about 10° C. (about 50° F.). The gas exiting the system 100 may be conveyed to a gas main to be directed to residential, commercial and industrial applications.

In some embodiments, the system 100 may be disposed on a mobile support, such as, a vehicle or a trailer. The ambient heaters 120 and 124 may also be disposed on the mobile support or, alternatively, may be separate from the mobile support. The system 100 may further include a heat source that provides heat to the ambient heaters 120 and 124. For example, the heat source may be suitable an internal combustion engine 125, as shown by dashed lines, used to provide power for transporting the system 100 on the mobile support. As a non-limiting example, the heat source may be such as used on a flameless nitrogen skid unit such as those described in U.S. Pat. No. 5,551,242 to Loesch et al., the entirety of which is hereby incorporated by reference in its entirety.

In other embodiments, the system 100 may be used to provide an uninterrupted O' natural gas source to end-users. For example, such a system 100 may be used to provide natural gas to power generation facilities, residences, local distribution companies, service centers, manufacturing plants, hospitals, and the like. The system 100 may be installed in a location in which a natural gas source is desired and compressed natural gas may be stored in containers, such as storage tanks.

The system 100 may further include monitoring equipment 127, such as, sensors, computers, and the like, for monitoring the pressure, temperature, flow rate, and the like, of the natural gas at various points in the system 100. Such monitoring equipment 127, as shown by dashed lines in FIG. 1, is well known in the art and is, thus, not described in detail herein.

The system 100 enables the pressure of natural gas to be reduced from about 3,000 psig to about 45 psig while substantially reducing or eliminating freeze up conditions that may result in loss of control or interruption of gas flow. For example, the temperature of the gas entering an end-users' system supplied from system 100 may be greater than or equal to about −28.9° C. (about −20° F.). The system 100 may be used to reduce the pressure of natural gas at flows less than or equal to about 8,500 scfh.

Figure 1A:
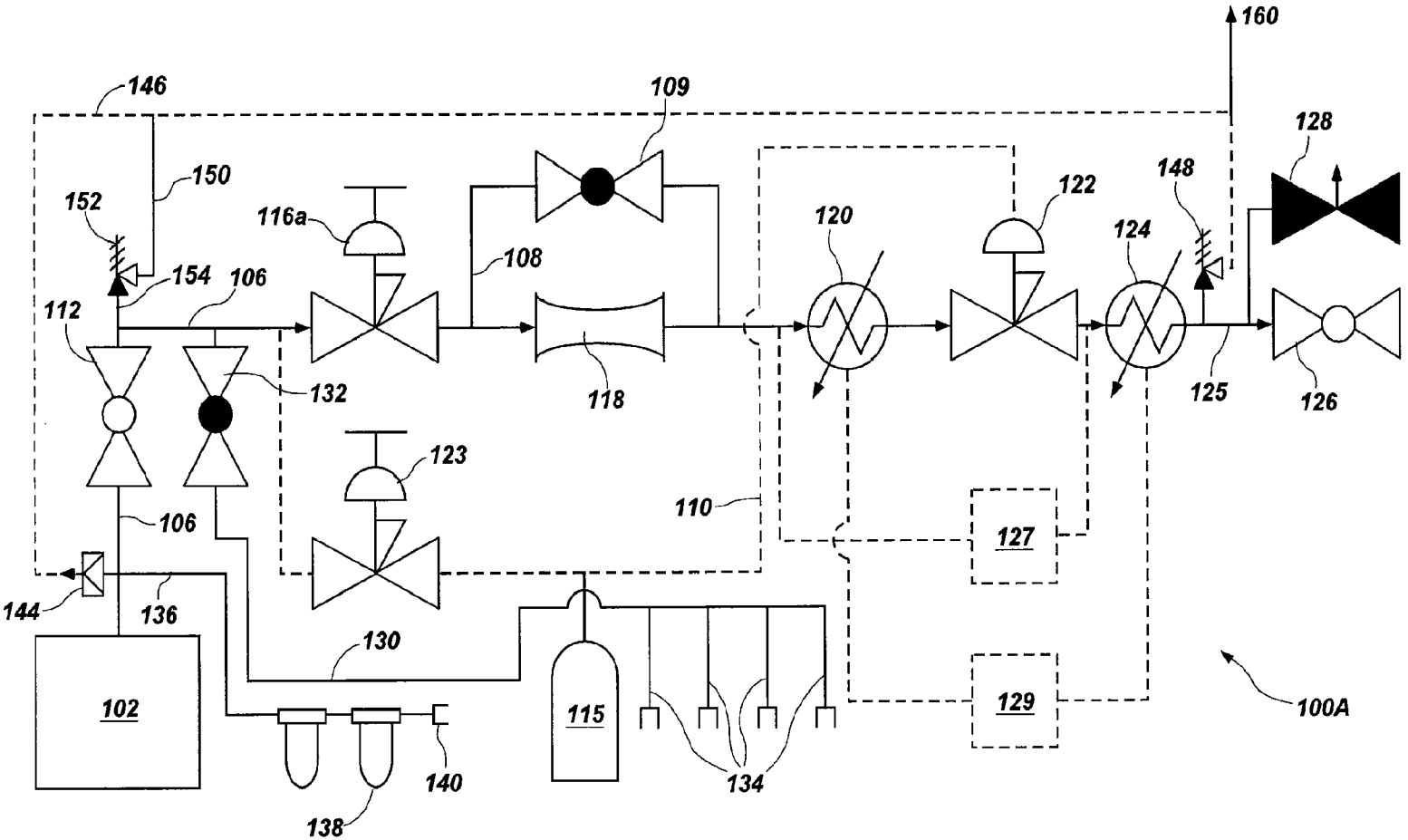

Another embodiment of a system 100A for reducing a pressure of natural gas is shown in a simplified schematic view in FIG. 1A. As shown in FIG. 1A, the gas may be stored in a compressed form in at least one storage vessel 102 and may be fed into the system 100A through a gas inlet 106. The gas may enter the system 100A from the storage vessel 102 at a pressure from about 2,000 psig to about 4,000 psig and, more particularly, about 3,000 psig. The system 100A may be configured to reduce the pressure of the gas from about 3,000 psig to pressures ranging from 40 psig to 300 psig and, more particularly, by as much as 2,960 psig. After entering the system 100A, the gas may be fed through gas flow line 106 and may, optionally, be diverted to static pressure line 110, as will be described in further detail. A flow rate of the gas within the system 100A may be less than or equal to about 8,500 standard cubic feet per hour (scfh).

The gas may be directed though the gas flow line 106 to a first regulator 116*a* configured to substantially reduce the pressure of the gas. The first regulator 116*a* may be a Joule-Thomson expansion valve, a diaphragm regulator or a needle valve regulator, such as, those commercially available from Bryan Donkin RMG (Germany), Elster-Instromet A/S (Denmark) and Tescom-Emerson Process Management (Elk River, Minn.). The pressure of the gas may be reduced by the first regulator 116*a* such that the gas exiting the first regulator 116*a* has a pressure in the range from about 1,500 psig to about 2,500 psig at a location in the gas flow line 106.

The gas may be fed from the first regulator 116*a* to a second regulator 122, and to a vortex regulator 118. The second regulator 122 may be a gas loaded diaphragm regulator-type valve, commonly commercially available from a variety of sources for use in a variety of pressure ranges. Alternatively, a Venturi nozzle or any orifice, such as, a valve or a narrow jet, may be used instead of the vortex regulator 118. For example, the vortex regulator 118 may include a vortex tube, examples of which are disclosed and discussed herein and are incorporated by reference in its entirety herein.

The vortex regulator 118 may be configured to substantially reduce the pressure of the gas using a method such as that disclosed in U.S. Pat. No. 5,327,728 to Tunkel, which is hereby incorporated by reference in its entirety. Such a vortex regulator may be obtained from Universal Vortex, Inc. (Robbinsville, N.J.). The vortex regulator 118 may reduce the pressure of the gas from about 3,000 psig to a pressure in the range of about 150 psig to 500 psig for gas flows ranging from about 1,800 scfh to about 8,500 scfh without experiencing regulator freeze up, thereby either reducing or stopping the flow therethrough. The vortex regulator 118 may produce a hot gas fraction during the pressure reduction process that is diverted onto surfaces of the vortex regulator 118 to prevent the formation of ice and mitigate the potential freeze up condition associated with high-pressure reduction of gas forming hydrates and ice in the gas. The pressure of the gas may be reduced by the vortex regulator 118 so that the gas exiting has a pressure in the range of about 150 psig to about 500 psig and, more particularly, about 150 psig.

If necessary, the gas may be diverted to the bypass line 108 having ball valve 109 therein controlling flow through bypass line 108, which circumvents the vortex regulator 118. When not bypassed, the temperature of the gas is substantially reduced during pressure reduction by the vortex regulator 118 and the first regulator 116*a*. After exiting the vortex regulator 118, the temperature of the gas may be in the range of about −78.9° C. (about −110° F.) to about −56.7° C. (about −70° F.) and, more particularly, about −67.8° C. (about −90° F.). The reduction in pressure is advantageous to the system 100A due to the significant temperature drop that occurs due to the Joule-Kelvin effect. The temperature reduction associated with the pressure reduction in the gas is achieved by throttling the gas from through the vortex regulator 118 and the first regulator 116*a*. The temperature gradient between the temperature of the low temperature of the gas exiting the vortex regulator 118 and the temperature of the atmosphere surrounding the ambient heater 120 enables for significant heat input into the system 100A via ambient heater 120. The ambient heater 120 may be a heat exchanger having a forced convection surface area, or any other device configured for exchanging heat between gas and ambient air. The ambient heater 120 may be in fluid communication with the vortex regulator 118 and a surface of the ambient heater 120 may be in communication with the ambient air for transfer of heat from the ambient air to the natural gas. The system 100A may further include a fan (not shown) or other device for circulating the ambient air over the surface of the ambient heater 120. Energy transferred from the surrounding environment (i.e., ambient air) into the system 100A at a high rate through a convection process via the ambient heaters 120 and 124 may be determined as discussed hereinabove.

By achieving a large temperature gradient from a rapid two-stage pressure reduction using first regulator 116*a* and vortex regulator 118, with the primary pressure reduction occurring in the vortex regulator 118, heating of the gas exiting the first regulator 116*a* and the vortex regulator 118 may be achieved efficiently. The large temperature gradient achieved through pressure reduction by the vortex regulator 118 enables a substantial portion of the heating process to take place in the ambient heater 120.

The ambient heater 120 may be modeled as discussed herein before.

In some embodiments, an external heat source may be supplied to the ambient heater 120 to increase the efficiency of heating.

The gas exiting the ambient heater 120 may have a temperature of from about 0° C. to about 20° C. (about 68° F.) and, more particularly, may be about 10° C. (about 50° F.). The gas may be directed from the ambient heater 120 to a second regulator 122 configured to substantially reduce the pressure of the gas. Additionally, a portion of the gas may be directed from the gas inlet 106 to the static pressure line 110. The static pressure line 110 may maintain a constant pressure, the purpose of which is to control the outlet pressure of the second regulator 122. Gas may be directed through the static pressure line 110 by the regulator valve 123.

The second regulator 122 comprises a diaphragm regulator valve readily available from any commercial source, although the third regulator may comprise a Joule-Thomson expansion valve or a needle valve regulator such as, for example, a 26-1200 series high flow regulator which is commercially available from Tescom-Emerson Process Management. The second regulator 122 may control the pressure of the gas to enable for a large flow differential while substantially reducing or eliminating pressure spikes and ensuing incremental flow changes in the flow of gas exiting the second regulator 122. The second regulator 122 may reduce the pressure of the gas to from about 20 psig to about 100 psig and, more particularly, may be about 45 psig. In order to minimize any pressure fluctuations in the pressure of the gas in flow line 110 connected to gas flow line 106 and second regulator 122, gas flow line 106 having a hand-operated spring-loaded regulator valve 123 therein, an expansion tank 115, such as any suitable tank connected to static pressure line 110, is connected to the flow line 110 at any suitable location between the first regulator 116*a* and the second regulator 122 after the location of the regulator valve 123 in gas flow line 106. Also, by connecting flow line 110 to gas flow line 106 sufficient pressure may be available for facilitating the actuation of second regulator 122.

The gas exiting second regulator 122 may then be directed to another ambient heater 124 configured to increase the temperature of the gas within about 28.9° C. (about 20° F.) of an ambient temperature of the atmosphere surrounding the ambient heater 124, such as, in the range from about 28.9° C. (about 20° F.) to about 10° C. (about 50° F.). The gas exiting the system 100A may be conveyed to a gas main through either ball valve 126 or to another source through needle valve 128, which is in a normally closed position, to be directed to residential, commercial, and industrial applications. Any suitable type commercially available ball valve and needle valve may be used to for ball valve 126 and needle valve 128.

The system 100A may further include a storage vessel bypass line 130 having a ball valve 132 located therein and a plurality of connection couplers 134 connected thereto. The ball valve 132 may be any suitable type ball valve commercially available from a variety of sources. The connection couplers 134 attached to the storage vessel bypass line 130 may be any suitable type coupler commercially available. The storage vessel bypass line 130 may allow a plurality of additional systems such as system 100A to be connected (not shown) to the system 100A to provide pressurized gas to the system 100A in either series connection or parallel connection with storage vessel 102 of system 100A. Such additional systems, such as system 100A, may be disconnected, refilled, and reconnected to system 100A as desired.

The system 100A may include a line 130 connected to gas flow line 106 for the filling of another vessel or vehicle with gas from either the storage vessel 102 or other systems 100A connected to system 100A using the plurality of connectors 134.

The system 100A may include a relief line 146 connected to gas flow line 106 having a burst disc 144 therein, the burst disc 144 typically having a burst pressure of 4000 psig for the system 100A. The burst disc 144 may be connected to relief line 146, which may be connected to relief valve 148 that also may be connected to line 125 before ball O' valve 126. The relief line 146 may be also connected to line 150 that may be connected to relief valve 152 that may be connected by line 154 that may be connected to first regulator 112. As shown by directional arrow 160, a common vent stack or other apparatus may be included to enable gases to be released from the system 100A into the atmosphere.

In some embodiments, the system 100A may be disposed on a mobile support, such as, a vehicle or a trailer or a stationary unit. The ambient heaters 120 and 124 may also be disposed on the mobile support or stationary unit or, alternatively, may be separate from the mobile support or stationary unit. The system 100A may further include a heat source that provides heat to the ambient heaters 120 and 124. For example, the heat source may be suitable an internal combustion engine 129 used to provide power for transporting the system 100A on the mobile support. As a non-limiting example, the heat source may be used on a flameless nitrogen skid unit such as those described in U.S. Pat. No. 5,551,242 to Loesch et al., the entirety of which is hereby incorporated by reference in its entirety.

The first regulator 116*a* and the second regulator 122 in system 100A may be configured to work under dynamic flow conditions of the gas in system 100A. The first regulator 116*a* may be used to adjust critical pressure and flow in the vortex regulator 118, thereby allowing the first regulator 116*a* and the second regulator 122 to operate over a greater range for reducing pressure in the system 100A. The typical outlet pressure from the vortex regulator 118 may be in the range of about 200 psig to about 500 psig depending on the flow rate of gas and the upstream gas pressure in gas flow line 106. The process of coupling the first regulator 116*a* with the vortex regulator 118 may allow the thermal load caused by the reduction of the gas pressure in gas flow line 106 by the first regulator 116*a* to be transferred to the vortex regulator 118, thereby preventing the minimum temperature at which the first regulator 116*a* may be operated from being exceeded. The transfer of the thermal load transfer from the first regulator 116*a* to the vortex regulator 118 may occur during different flow rate ranges of the gas in the gas flow line 106 by changing the flow characteristics of the vortex regulator 118. Depending on the desired flow rate of gas from the system 100A, the first regulator 116*a* may be adjusted to establish a critical flow state of gas through the vortex regulator 118, by increasing or decreasing the inlet pressure to the vortex regulator 118 using the first regulator 116*a*. Typically, an initial pressure reduction by the first regulator 116*a* may be greater than 2000 psig in the gas flow line 106 and may cause freezing and malfunction of the first regulator 116*a* due to gas hydrates and ice.

When flow rates are less than those required to establish critical flow in the vortex regulator 118, pressure reduction may be achieved by balancing the amount of pressure reduction between the first regulator 116*a* and the amount of pressure reduction of the second regulator 122. By balancing the amount of pressure reduction between the first regulator 116*a* and the second regulator 122, such may prevent either the first regulator 116*a* or the second regulator 122 from exceeding minimum operating temperatures therefore. While any supersonic converging or diverging nozzle, rather than the use of vortex regulator 118, may be capable of achieving the desired advantage of extending the pressure reduction range of either first regulator 116*a* and second regulator 122, in order to minimize hydrate formation in the gas flowing in the system 100A, the use of vortex regulator 118 is advantageous, as the vortex regulator 118 may provide heat to the pressure reducing surfaces of the vortex regulator 118 thereby minimizing the formation and build up of hydrates and ice that may block or reduce flow through the vortex regulator 118. The vortex regulator 118 should be configured for achieving the largest possible pressure drop across the vortex regulator 118 without exceeding the minimum temperature at which the first regulator 116*a* may be operated. Using a method of balancing the pressure reduction of gas flowing through first regulator 116*a* and the pressure reduction of the gas flowing through vortex regulator 118 may allow for a wide array of inlet pressures of gas and flow rates of gas through the system 100A.

The outlet pressure of the gas flowing from system 100A may be controlled by the second regulator 122 by maintaining stable flow of the gas in the system 100A during dynamic fluctuations of the flow and pressure of the gas flowing into an inlet to system 100A and the gas flowing from an outlet of system 100A. However, due to pressure pulsations in the system 100A causing the movement of the diaphragms used in the second regulator 122, an expansion tank 115 in line 110 may be required to prevent pressure spikes in the second regulator 122. The second regulator 122 should be configured to have a very large flow coefficient for the flow of gas therethrough to accommodate large flows of gas through the system 100A, when the system 100A is operated having a low-pressure differential of gas flowing into the inlet of system 100A and the gas flowing from the outlet of system 100A. Moreover, the second regulator 122 should be extremely responsive to pressure fluctuations of a distribution system connected to system 100A so that the system 100A may be providing regulated gas thereto. In order to accomplish pressure stabilization of the injection pressure of gas caused by a distribution system connected to the system 100A, an increased pressure load is placed on the diaphragm of second regulator 122 through line 110 connected thereto affect the operation of second regulator 122.

The ambient heater 120 may increase the temperature of gas flowing therethrough to within 20° F. of the ambient atmosphere of the ambient heater 120 before the gas enters the second regulator 122. The addition of heat between the first regulator 116*a* and the second regulator 122 should prevent the second regulator 122 from exceeding the minimum temperature at which the second regulator 122 should be operated. The ambient heater 124 may be used to adjust the temperature of the gas flowing therethrough after slight pressure reduction of the gas flowing through the second regulator 122.

During high flow rates of gas in the system 100A, the largest pressure reduction of the gas in the system 100A should occur across the combination of the first regulator 116*a* and the vortex regulator 118 thereby causing a significant decrease in temperature of the gas flowing therethrough. At high flow rates of the gas in the system 100A, a significant temperature decrease of the gas flowing through the combination of the first regulator 116*a* and the vortex regulator 118 may be advantageous to the flow process occurring through the system 100A. The heat recovery in the system 100A may be significant due to the temperature of the gas being increased between the surrounding atmospheres of the ambient heaters 120 and 124 and the temperature of the gas flowing through the ambient heaters 120 and 124. The ambient heaters 120 and 124 may be operated at the temperature of the surrounding atmosphere thereto, causing a large difference between the temperature of the atmosphere surrounding the ambient heaters 120 and 124 and the temperature of the gas flowing therethrough. When a large temperature differential occurs between the temperature of the atmospheres surrounding the ambient heaters 120 and 124 and the temperature of the gas flowing therethrough, such may create an efficient heat transfer to the gas flowing in the system 100A.

During low flow of gas in the system 100A, when the pressure reduction of the gas flowing in the system 100A is balanced between the first regulator 116*a* and the second regulator 122, the gas flowing in the system 100A may have a greater increase of the temperature of the gas flowing through ambient heaters 120 and 124. During low flow of gas in the system 100A, the increase in the duration time of the gas flowing through the ambient heaters 120 and 124, the heat transfer to the gas flowing through the ambient heaters 120 and 124 may be significantly increased regardless of the ambient temperature of the atmospheres surrounding the ambient heaters 120 and 124 and the amount of decrease of the temperature of the gas flowing through the system 100A caused by the second regulator 116*a*, the vortex regulator 118, and the second regulator 122.

In the system 100A, gas may enter the system 100A having a pressure of about 3000 psig when the storage vessel 102 and any other storage vessels connected to line 130 are fully charged prior to first regulator 116*a*. Gas flow may be adjusted in the system 100A by the first regulator 116*a* to establish critical rate of gas flow in the vortex regulator 118. Gas flowing from the vortex regulator 118 through the ambient heater 120 restores the temperature of the gas to about 20° F. lower than the temperature of the surrounding atmosphere of the ambient heater 120. The gas exiting the ambient heater 120 may have the pressure thereof and the temperature thereof controlled by second regulator 122 thereby stabilizing the outlet pressure of the gas flowing from second regulator 122 for the stabilized pressure required for gas to flow into a system connected to the system 100A. Gas flows from the second regulator 122 through the ambient heater 124 may increase the temperature of the gas to about 20° F. of the temperature of the atmosphere surrounding the ambient heater 124. Subsequent to the gas flowing from ambient heater 124, gas may flow from the system 100A after flowing through either ball valve 126 or needle valve 128 of the system 100A.

By the system 100A having a plurality of connections 134 and ball valve 132 controlling the flow of gas therefrom, such may allow the system 100A to operate in parallel with a separate system or systems connected thereto using connectors 134 and the system 100A to be operated in series or parallel with any system or systems connected to connectors 134. Further, system 100A may be directly connected to another system (note shown) to supply gas thereto, while another system may act as an additional source of gas for system 100A that may be disconnected from system 100A when the another system of gas is empty to be refilled for use with system 100A or replaced by another system. When such another system is connected to system 100A, system 100A may continue to supply gas from its own storage vessel 102 to another system connected to ball valve 126.

The connector 134 allows the system 100A to operate as a mobile filling station for vehicles powered by natural gas or to fill vessels with natural gas.

The first regulator 116*a*, vortex regulator 118, and second regulator 122 used in system 100A are configured to operate under the dynamic flow of gas. The first regulator 116*a* may be used to adjust and maintain critical flow through vortex regulator 118 in a variety of flow conditions of gas through system 100A.

In other embodiments, the system 100A may be used to provide an uninterrupted natural gas source to end-users. For example, such a system 100A may be used to provide natural gas to power generation facilities, residences, local distribution companies, service centers, manufacturing plants, hospitals, and the like. The system 100A may be installed in a location in which a natural gas source is desired and compressed natural gas may be stored in containers, such as storage tanks.

The system 100A may further include monitoring equipment 127, such as, sensors, computers, and the like, for monitoring the pressure, temperature, flow rate, and the like, of the natural gas at various points in the system 100A. Such monitoring equipment 127 is well known in the art and is, thus, not described in detail herein.

The system 100A will enable the pressure of natural gas to be reduced from about 3,000 psig to about 45 psig while substantially reducing or eliminating freeze up conditions that may result in loss of control or interruption of gas flow. For example, the temperature of the gas entering any end-users' system supplied from system 100A may be greater than or equal to about −28.9° C. (about −20° F.). The system 100A may be used to reduce the pressure of natural gas at flows less than or equal to about 8,500 scfh.

Figure 2:
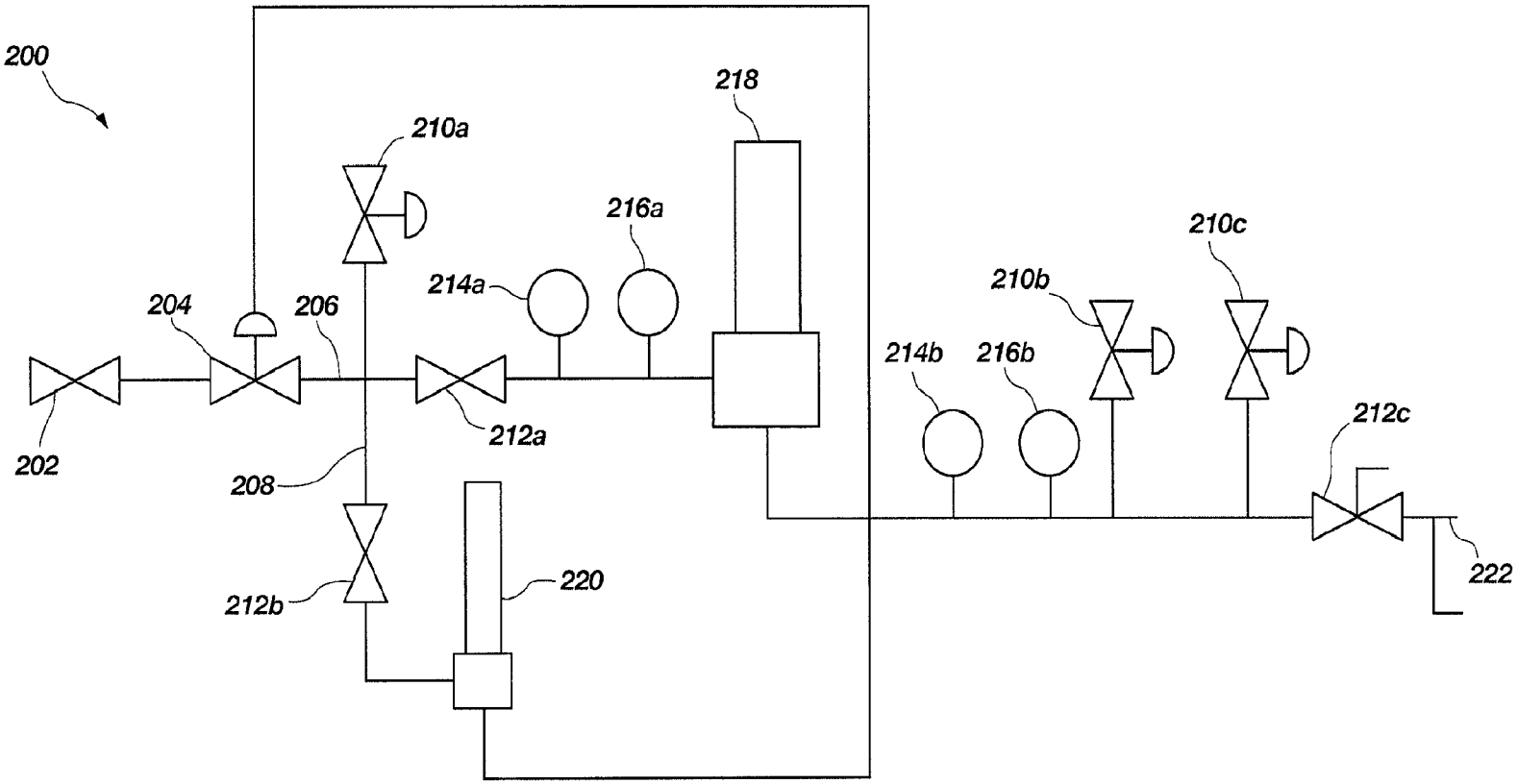

Another embodiment of an embodiment of a system 200 for reducing a pressure of natural gas is shown in a simplified schematic view in FIG. 2. The gas may enter the system 200 through a gas inlet valve 202 at a pressure of from about 2,000 psig to about 4,000 psig and, more particularly, about 3,000 psig. The gas may be fed through a high pressure-reducing regulator 204 such as, for example, a diaphragm regulator or a needle valve regulator. The high pressure-reducing regulator 204 may reduce a pressure of the gas to from about 1,000 psig to about 3,000 psig. From the high pressure-reducing regulator 204, the gas may be fed into a gas flow line 206 or may, optionally, be diverted to a bypass line 208. A flow rate of the gas within the system 200 may be less than about 1,800 mscfh.

The system 200 may include a first pressure relief valve 210*a* along the gas flow line 206 that may be used to release excess pressure from the system 200. The pressure relief valve 210*a* may be, for example, a pilot-operated or spring-operated pressure relief valve. Examples of pressure relief valves include Anderson Greenwood valves, which are available from Tyco Flow Control (Princeton, N.J.). A portion of the gas may be directed through the gas flow line 206 through a first valve 212*a* to a high flow vortex regulator 218. The first valve 212*a* may be, for example, a ball valve. The gas flow line 206 may, optionally, include a first temperature gauge 214*a* and a first pressure gauge 216*a* that may be used to determine at least one setting of the high flow vortex regulator 218. The high flow vortex regulator 218 may include a vortex tube and may be configured to substantially reduce the pressure and temperature of the gas. By way of non-limiting example, the high flow vortex regulator 218 may reduce the pressure and temperature of the gas so that the gas exiting therefrom has a pressure of from about 300 psig to about 50 psig and, more particularly, about 150 psig and a temperature of from about −78.9° C. (about −110° F.) to about −56.7° C. (about −70° F.) and, more particularly, about −67.8° C. (about −90° F.).

In some embodiments, where a volumetric flow demand of the gas may be sufficiently low, at least a portion of the gas may be diverted to the bypass line 208, which circumvents the high flow vortex regulator 218. The gas may be fed through the bypass line 208 to a low flow vortex regulator 220 by a second valve 212*b*. The reduced pressure gas may be fed from the low flow vortex regulator 220 to the gas flow line 206 at a pressure of from about 300 psig to about 50 psig and, more particularly, of about 150 psig and a temperature of about −78.9° C. (about −110° F.) to about −56.7° C. (about −70° F.) and, more particularly, about −67.8° C. (about −90° F.).

The gas flow line 206 may include a second temperature gauge 214*b*, a second pressure gauge 216*b*, a second pressure relief valve 210*b* and a third pressure relief valve 210*c*. The gas may be directed to an outlet 222 via a system 200 at a substantially reduced pressure, such as, a pressure of from about 5 psig to about 200 psig.

Figure 3A:
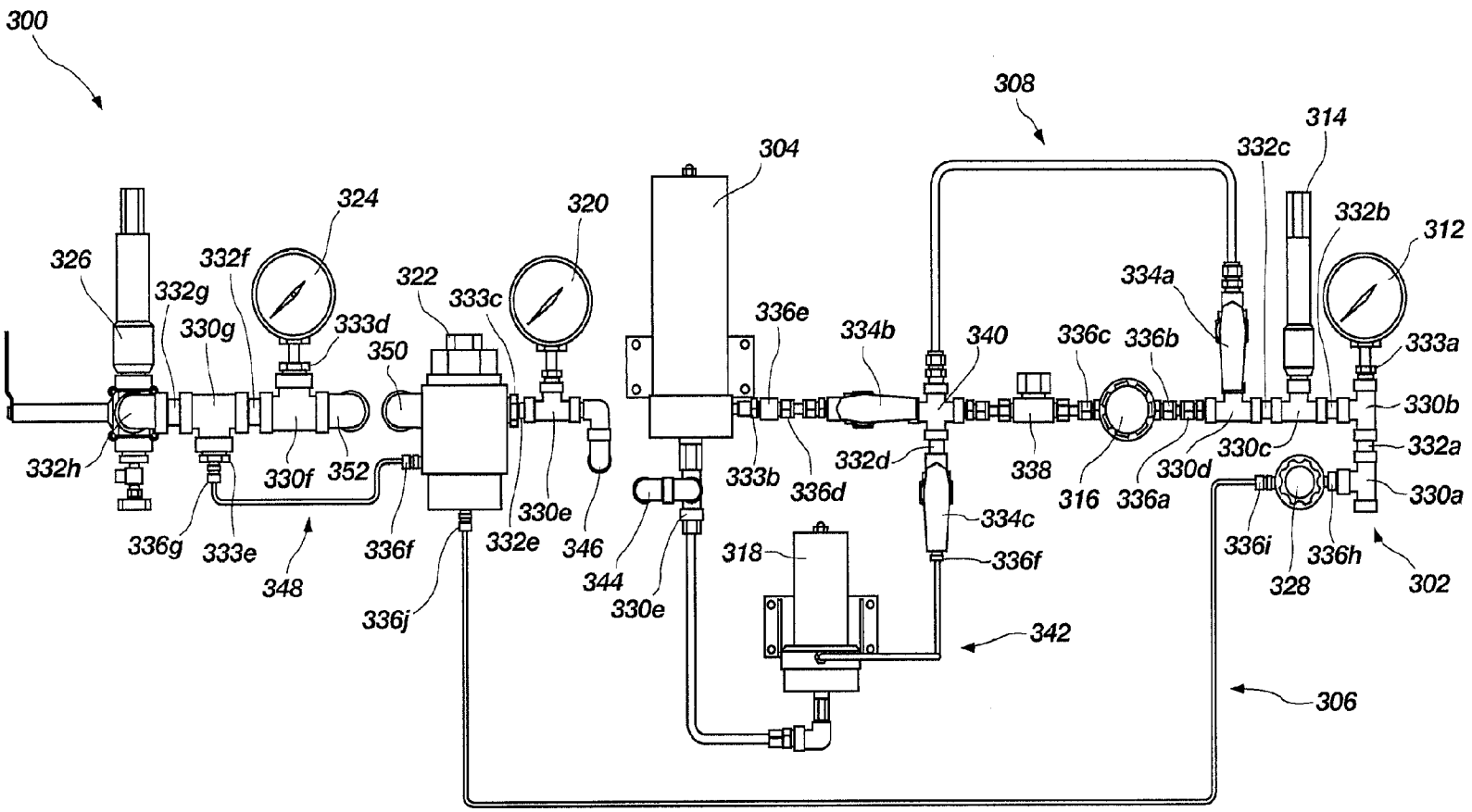
Figure 3B:
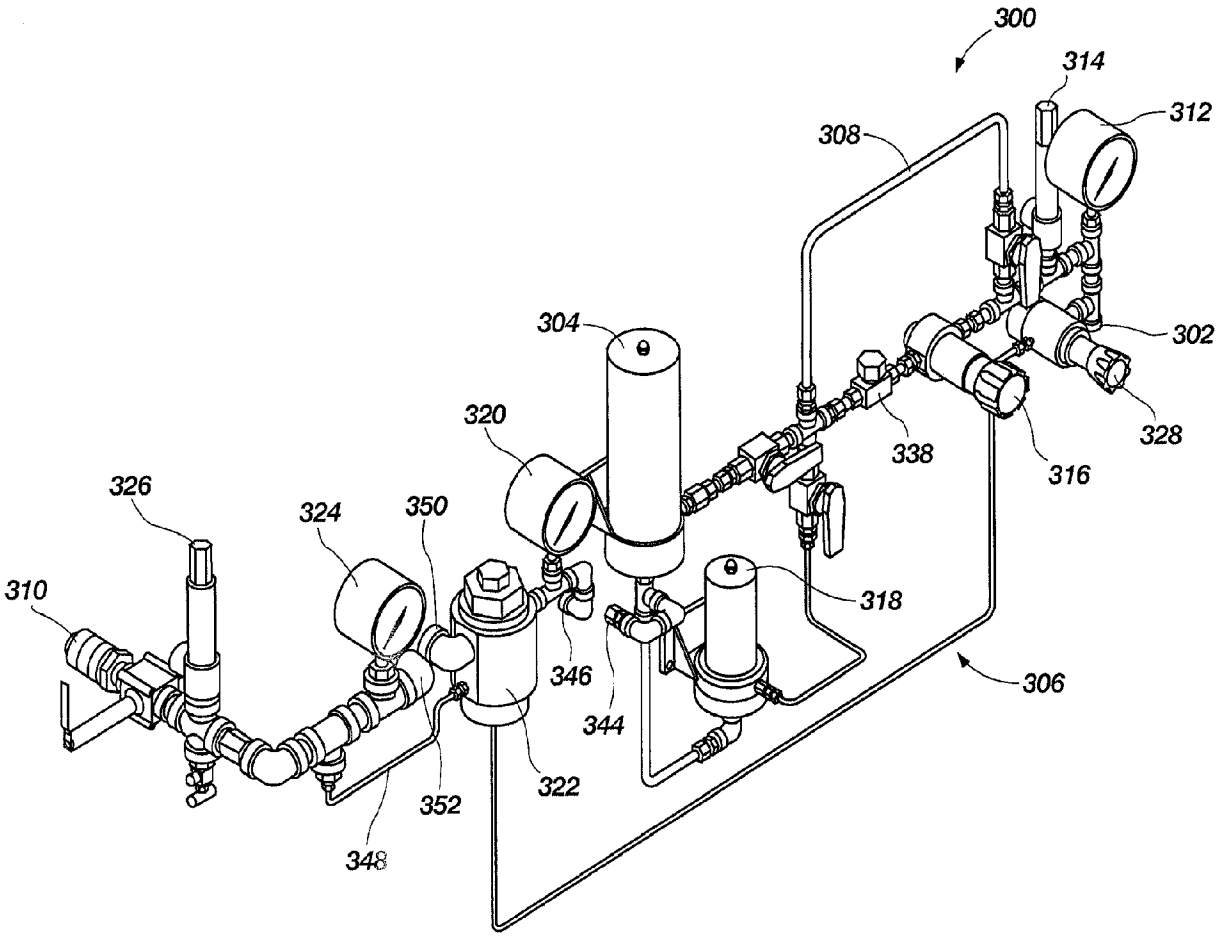

Another embodiment of a system 300 for reducing pressure of a gas, such as natural gas, is shown in a simplified schematic view in FIGS. 3A and 3B. FIG. 3A is a side view of the system 300 while FIG. 3B is a perspective view of the system 300. The system 300 may include a gas inlet 302, which may be connected to a gas source such as, for example, a storage tank (not shown). The system 300 may also include a high flow vortex regulator 304, a first ambient heater (not shown), a static pressure line 306, a high flow bypass line 308 and a gas outlet 310. The system 300 may also, optionally, include a first pressure gauge 312, a first pressure relief valve 314, a pressure controller 316, a low flow vortex regulator 318, a second pressure gauge 320, a pressure regulator 322, a second ambient heater (not shown), a third pressure gauge 324 and a second pressure relief valve 326. The static pressure line 306 may include an injection regulator 328.

Upon entering the gas inlet 302, a portion of the gas may be directed to the pressure controller 316 or the static pressure line 306. For example, the gas may be directed to at least one of the pressure controller 316 and the static pressure line 306 by a t-shaped connector 330*a*, such as, an SS-1610-1-16 connector that is available from Swagelok Company. The pressure of the gas entering the pressure controller 316 may be determined using the first pressure gauge 312, or other pressure-measuring device. As a non-limiting example, the first pressure gauge 312 may be a PGI-115P industrial pressure gauge available from Swagelok Company. For example, the first pressure gauge 312 may be connected to the gas inlet 302 by way of a t-shaped connector 330*b*, similar to that previously described, and reducing bushing 333*a*. The reducing bushing 333*a* may be, for example, an SS-4-RB-2 stainless steel pipe fitting-reducing bushing or an SS-8-RB-4 stainless steel pipe fitting-reducing bushing, each of which is available from Swagelok Company. The t-shaped connectors 330*a* and 330*b* may be connected to one another by way of a fitting 332*a* such as, for example, an SS-8-CN stainless steel pipe fitting, close nipple, available from Swagelok Company.

The first pressure relief valve 314 may be connected to the first pressure gauge 312 by a fitting 332*b* and a t-shaped connector 330*c* similar to those previously described. The first pressure relief valve 314 may be a direct spring-operated pressure relief valve such as an Anderson Greenwood Type 81 pressure relief valve, which is available from Tyco Flow Control. The first pressure relief valve 314 may be in fluid communication with the high flow bypass line 308 via t-shaped connector 330*d* and valve 334*a*. For example, the valve 334*a* may be a ball valve such as a three-piece high-pressure alternative fuel service valve, which is available from Swagelok Company. The first pressure relief valve 314 may be in fluid communication with the pressure controller 316 via the t-shaped connector 330*d* and tube connectors 336*a* and 336*b*. The tube connectors 336*a* and 336*b* may be stainless steel connectors such as, for example, an SS-810, SS-1610 and SS-400 tube fitting connectors available from Swagelok Company. The pressure controller 316 may be used, for example, to control the flow of the gas into the high flow vortex regulator 304. The pressure controller 316 may be a high flow, pressure-reducing regulator or Joule-Thomson expansion valve and may have an inlet pressure of from about 3,570 psig to about 6,000 psig, an outlet pressure of from about 10 psig to about 2,500 psig and a flow capacity (Cv) of from about 0.8 to about 2. By way of non-limiting example, the pressure controller 316 may be a 44-1300 Series high flow/high pressure-reducing regulator, which is available from Tescom-Emerson Process Management. The pressure controller 316 may, optionally, be connected to or in fluid communication with a check valve 338 such as, for example, an SS-58S8-SC11 lift check valve that is available from Swagelok Company. The pressure controller 316 may prevent the gas pressure on an outlet of the check valve 338 from exceeding about 2,500 psig. A tube connector 336*c*, such as that previously described, may connect the pressure controller 316 and the check valve 338. The inlet 302 may be connected to or in fluid communication with the high flow bypass line 308 and in selective fluid communication with a low flow bypass line 342 via a cross-shaped connector 340, such as, an SS-8-VCR-CS 316 SS face seal fitting, which is available from Swagelok Company.

A valve 334*b* may, respectively, be disposed between the cross-shaped connector 340 and the high flow vortex regulator 304, and may be used to control fluid communication therebetween. The valve 334*b* may be connected to the high flow vortex regulator 304 by tube connectors 336*d* and 336*e*, such as those previously described. The high flow vortex regulator 304 may be obtained from Universal Vortex and may have a maximum flow volume of about 29,000 cubic feet per hour (about 821.188 cubic meters per hour). Optionally, a reducing bushing 333*b* may be disposed between the valve 334*b* and the high flow vortex regulator 304.

Another valve 334*c* may be disposed between the low flow bypass line 342 and the cross-shaped connector 340, and may be used to control fluid communication therebetween. As a non-limiting example, the valve 334*c* may be connected to the low flow bypass line 342 by a tube connector 336*f*, similar to those previously described, and may connected to the cross-shaped valve 340 by a fitting 332*d*, similar to those previously described. The low flow vortex regulator 318 may have a maximum flow rate of about 9,000 cubic feet per hour (about 254.851 cubic meters per hour).

The low flow vortex regulator 318 and the high flow vortex regulator 304 may each be in fluid communication with the first ambient heater (not shown) via an ambient heater inlet 344. The ambient heater inlet 344 may include a fitting, such as, an SS-8-SE street elbow fitting which is available from Swagelok Company, which may be connected to the low flow bypass line 342 and the high flow vortex regulator 304 by a t-shaped connector 330*e*, similar as those previously described.

The first ambient heater (not shown) may be in fluid communication with the pressure regulator 322 via an ambient gas flow outlet 346. The ambient gas flow outlet 346 may include a fitting such as those previously described with respect to the ambient heater inlet 334. The pressure regulator 322 may be, for example, a regulator having an inlet pressure of from about 6,000 psig to about 10,000 psig, an outlet pressure of from about 55 psig to about 6,000 psig and a flow capacity (Cv) of from about 3.3 to about 12. As a non-limiting example, the pressure regulator 322 may be a diaphragm sensed pressure-reducing regulator such as a 26-1200 Series high flow regulator, which is commercially available from Tescom-Emerson Process Management. The second pressure gauge 320, or other pressure measuring apparatus, and a reducing bushing 333*c* may, optionally, be disposed between the ambient gas outlet 346 and the pressure regulator 322. The pressure regulator 322 or the reducing bushing 333*c*, if present, may be connected to the t-shaped connector 330*e* by a fitting 332*e*.

The pressure regulator 322 may be in fluid communication with the second ambient heater (not shown) and a heater bypass line 348 via a second heater inlet 350 and a second heater outlet 352. The second ambient heater may, optionally, be connected to a third pressure gauge 324 or other similar pressure-measuring device, through a t-shaped connector 330*f* and a reducing bushing 333*d*, similar to those previously described.

The heater bypass line 348 may be in fluid communication with the pressure regulator 322 via a t-shaped connector 330*g*, similar to those previously described. The heater bypass line 348 may be connected to the pressure regulator 322 at one end and to the t-shaped connector 330*g* at an opposite end by tube connectors 332*f* and 332*g*. Optionally, a reducing bushing 333*e* may be disposed Fittings 332*e* and 332*g* may be used to interconnect the t-shaped connectors 330*f* and 330*g* and a fitting 332*h* connected to the second pressure relief valve 326. By way of non-limiting example, the second pressure relief valve 326 may be a direct spring operated valve, such as, an Anderson Greenwood Type 81 pressure relief valve, which is available from Tyco Flow Control.

The static pressure line 306 may include the injection regulator 328 having an inlet pressure of from about 6,000 psig to about 10,000 psig, an outlet pressure of from about 5 psig to about 6,000 psig and a flow capacity (Cv) of from about 0.02 to about 0.12. The static pressure line 306 and the injection regulator 328 may be used to maintain a static pressure on the pressure regulator 322. For example, the injection regulator 328 may be a 44-1100 Series high pressure-reducing regulator, which is available from Tescom-Emerson Process Management. As a non-limiting example, the static pressure line 306 may be connected to the gas inlet 302 by a tube connector 336*h* and may be connected to the pressure regulator 322 by tube connectors 336*i* and 336*j*, such as those previously described.

Figure 3C:
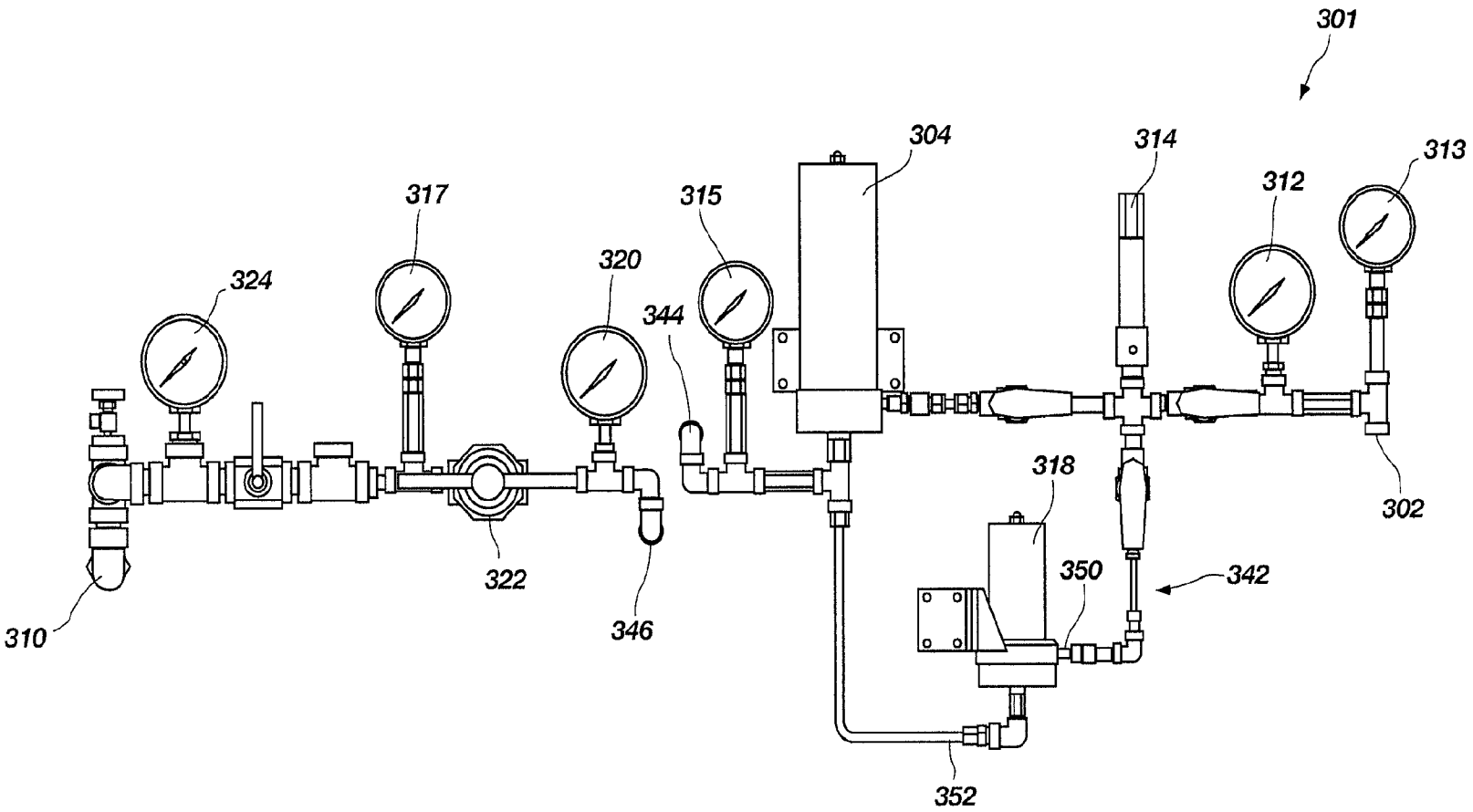

A system 301 for reducing the pressure of a gas similar to that shown in FIGS. 3A and 3B is shown in FIG. 3C. The system 301 may include gas inlet 302, pressure relief valve 314, high flow vortex regulator 304, low flow vortex regulator 318, ambient heater (not shown), second regulator 322 and outlet 310. Optionally, the system 301 may include first, second and third temperature gauges 313, 315 and 317 and first, second and third pressure gauges 312, 320 and 324.

Referring to FIGS. 3A-3C, after entering the gas inlet 302, the pressure of the gas entering gas inlet 302 may be determined using the first pressure gauge 312. For example, the pressure of the gas may enter the gas inlet 302 at a pressure of from about 1,500 psig to about 4,500 psig and, more particularly, about 3,000 psig. As the gas is directed in through the inlet 302, excess pressure may be released by the first pressure relief valve 314. As shown in FIGS. 3A and 3B, the gas may, optionally, be directed to the pressure controller 316 that may reduce a pressure of the gas such that the gas exiting therefrom has a pressure of from about 1,500 psig to about 2,500 psig. Where a volumetric flow demand of the gas may be sufficiently low, at least a portion of the gas may be diverted to the high flow bypass line 308, which circumvents the pressure controller 316.

Optionally, the gas, or a portion thereof, may be directed to the low flow bypass line 342, and may be passed though the low flow vortex pressure reducer 318, which substantially reduces the pressure of the gas. As a non-limiting example, the gas exiting the low flow vortex regulator 318 may have a pressure of from about 150 psig to about 2,000 psig. The gas may be directed to the high flow vortex regulator 304 wherein the pressure of the gas is substantially reduced. For example, the gas entering the high flow vortex regulator 304 may exhibit a pressure of from about 500 psig to about 2,500 psig and may exit having a pressure of from about 50 psig to about 2,000 psig and, more particularly, about 145 psig. A temperature of the gas may also be substantially decreased during pressure reduction by the high flow vortex regulator 304 For example, the gas exiting the high flow vortex regulator 304 may have a temperature of from about −78.9° C. (about 110° F.) to about −56.7° C. (about −70° F.) and, more particularly, about −67.8° C. (about −90° F.).

The gas may be directed through the ambient heater inlet 344 to the first ambient heater (not shown), which may substantially increase the temperature of the gas. For example, the gas exiting the first ambient heater may have a temperature of from about 0° C. to about 20° C. and, more particularly, about 10° C. The gas may then be directed through the ambient gas flow outlet 346 to the pressure regulator 322 wherein the pressure of the gas may be reduced to from about 15 psig to about 75 psig and, more particularly, about 45 psig. Optionally, the pressure of the gas may be determined before entering the pressure regulator 322 using the second pressure gauge 320.

The gas exiting the pressure regulator 322 may, optionally, be directed to the second ambient heater (not shown) by the second heater inlet 350, as shown in FIGS. 3A and 3B, wherein a temperature of the gas may be increased. As a non-limiting example, gas exiting the second heater outlet 352 may have a temperature of within about −7° C. (about 20° F.) of ambient temperature. A portion of the gas may be directed around the second ambient heater by the heater bypass line 348 (FIGS. 3A and 3B). After exiting the second ambient heater via the second heater outlet 352, a pressure of the gas may be determined using the third pressure gauge 324. The gas may be directed through the outlet 310. Excess pressure may be released from the system 300 by the second pressure relief valve 326.

Figure 4:
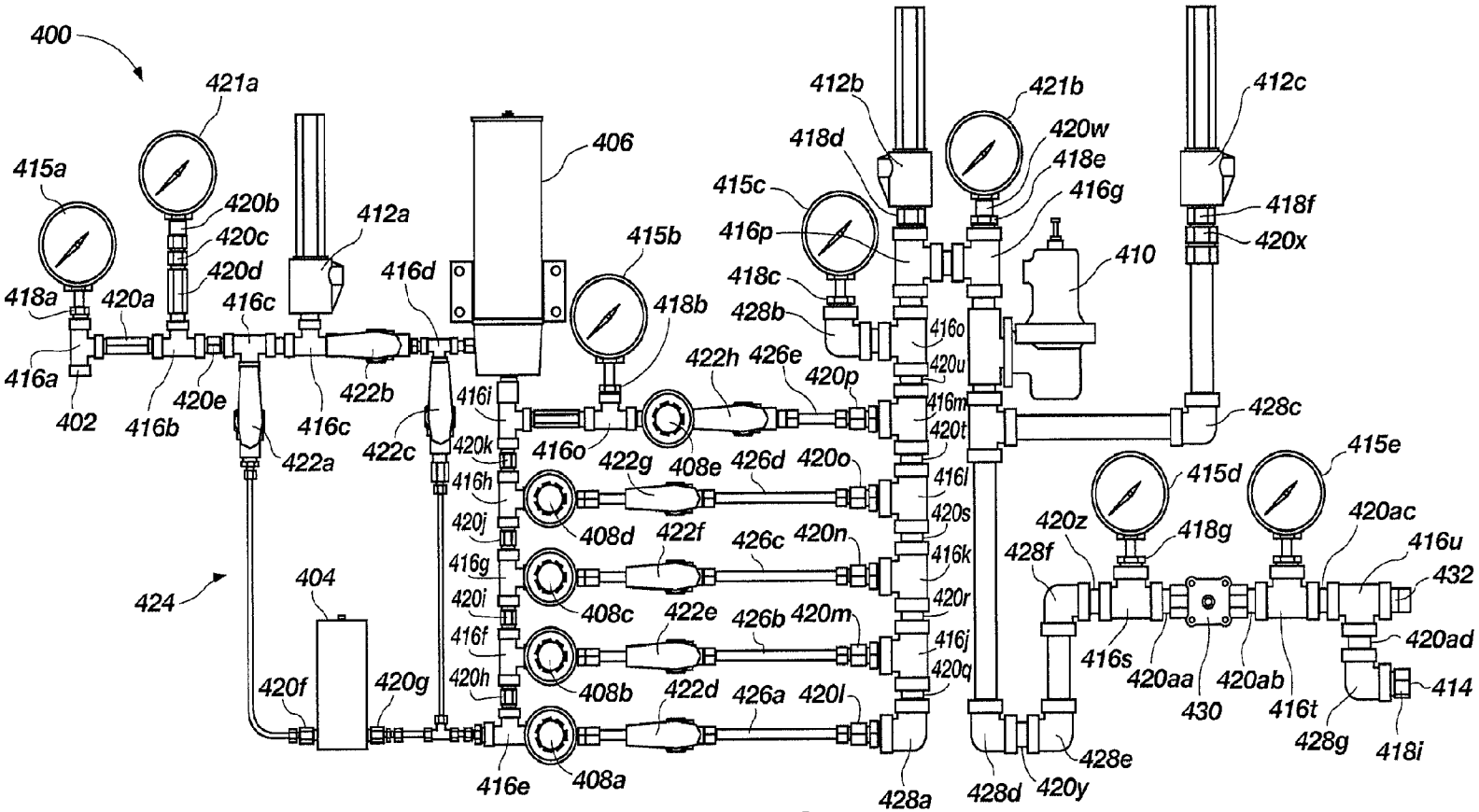
Figure 5B:
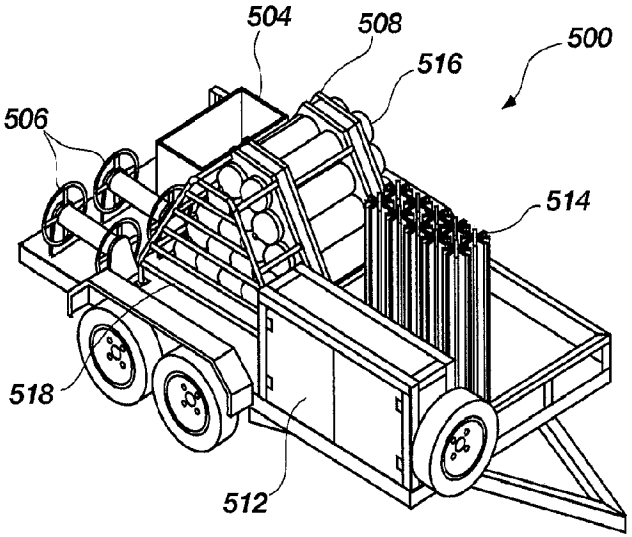
FIG. 5B is a perspective view of the system depicted in FIG. 5A.
Figure 5A:
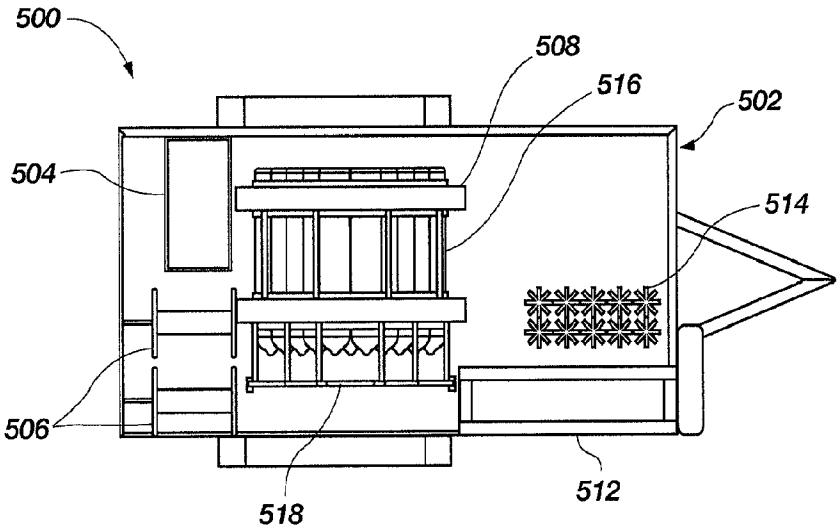
FIG. 5A is a top-down view of an embodiment of a system for delivering natural gas.
Figure 5D:
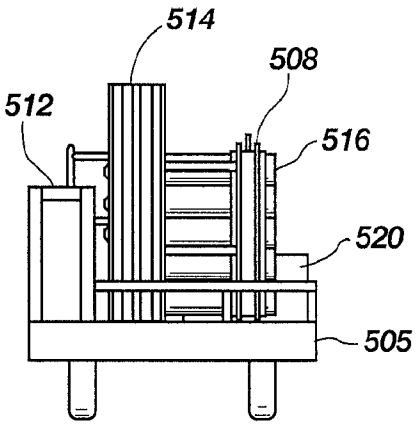
FIGS. 5C and 5D are side views of another embodiment of a system for delivering natural gas.
Figure 5C:
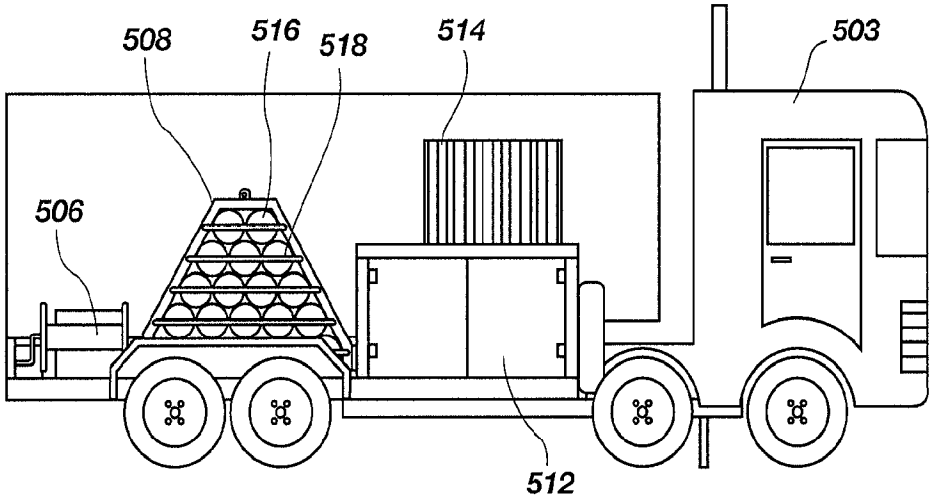

Another embodiment of a system 400 for reducing pressure of a gas, such as natural gas, is shown in a simplified schematic view in FIG. 4. The system 400 may include an inlet 402, a low flow vortex regulator 404, a high flow vortex regulator 406, a series of pressure-reducing regulators 408*a*, 408*b*, 408*c*, 408*d* and 408*e*, another pressure-reducing regulator 410, pressure relief valves 412*a*, 412*b* and 412*c* and an outlet 414. The inlet 402 may be connected to a first pressure gauge 415*a*, for example, by a t-shaped connector 416*a* and a reducing bushing 418*a*. As a non-limiting example, the first pressure gauge 415*a* may be a PGI Series pressure gauge, which is available from Swagelok Company. The t-shaped connector 416*a* may be, for example, an SS-8-T, an SS-4-T, an SS-16-T, an SS-8-ST, an SS-8-BT, an SS-400-3 tube fitting, each of which is available from Swagelok Company, or any other suitable t-shaped connector. The reducing bushing 418*a* may be, for example, an SS-8-RB reducing bushing or an SS-16-RB reducing bushing, each of which is available from Swagelok Company. The inlet 402 may be in fluid communication with a first temperature gauge 421*a* to which it is connected by a fitting 420*a* and a t-shaped connector 416*b*. For example, the fitting 420*a* may be an SS-8-HLN hex-reducing nipple, an SS-16-HRN hex-reducing nipple, an SS-810 connector, or an SS-400 connector, each of which is available from Swagelok Company, or an NPT fitting, which is available from Omega Engineering (Stamford, Conn.), or any other suitable fitting. As a non-limiting example, the first temperature gauge 421*a* may be a DURATEMP® thermometer gauge from Ashcroft, Inc. (Stratford, Conn.). The first temperature gauge 421*a* may be connected to the t-shaped connector 416*b* by fittings 420*b*, 420*c* and 420*d*, which are similar to the fittings previously described.

The t-shaped connector 416*b* may be connected to another t-shaped connector 416*c* by a fitting 420*e*. The t-shaped connector 416*b* may be connected to a valve 422*a* leading to a bypass line 424 and to another t-shaped connector 416*c* connected to a first pressure release valve 412*a*. The valve 422*a* may be, for example, an SS-AFSF8 ball valve or an SS-AFSS8 ball valve, which are available from Swagelok Company, or any other device suitable for controlling gas flow. The bypass line 424 may include the low flow vortex regulator 404 coupled thereto by fittings 420*f* and 420*g* similar to those previously described. The bypass line 424 may be in fluid communication the high flow vortex regulator 406 via a t-shaped connector 416*d*. The bypass line 424 and the first pressure relief valve 412*a* may be in selective fluid communication with the high flow vortex regulator 406 via valves 422*b*, 422*c* and a t-shaped valve 416*d*. The high flow vortex regulator 406 and the low flow vortex regulator 404 may each be in fluid communication with a series of pressure-reducing regulators 408*a*, 408*b*, 408*c*, 408*d* and 408*e*. The low flow vortex regulator 404 may have a maximum flow rate of about 9 million cubic feet per hour (about 254,851.6 cubic meters per hour). The high flow vortex regulator 406 may have a maximum flow volume of about 25 million cubic feet per hour (about 707,921.175 cubic meters per hour).

Optionally, a second pressure gauge 415*b* may be disposed between the high flow vortex regulator 406 and at least one of the pressure-reducing regulators 408*a*, 408*b*, 408*c*, 408*d* and 408*e*. As a non-limiting example, each of the pressure-reducing regulators 408*a*, 408*b*, 408*c*, 408*d* and 408*e* has a maximum inlet pressure of 3,600 psig, a pressure control range of from about 0 psig to about 250 psig, a flow coefficient of about 1.0 Cv and a maximum operating temperature of about 200° C. Each of the pressure-reducing regulators 408*a*, 408*b*, 408*c*, 408*d* and 408*e* may be, for example, a high-flow, high-sensitivity, diaphragm-sensing pressure regulator, such as, a KHF Series pressure-reducing regulator available from Swagelok Company. The pressure-reducing regulators 408*a*, 408*b*, 408*c*, 408*d* and 408*e* may be connected via t-shaped connectors 416*e*, 416*f*, 416*g*, 416*h* and 416*i* and fittings 420*h*, 420*i*, 420*j* and 420*k*. Each of the pressure-reducing regulators 408*a*, 408*b*, 408*c*, 408*d* and 408*e* may be connected to one of valves 422*d*, 422*e*, 422*f*, 422*g*, and 422*h*. Each of the valves 422*d*, 422*e*, 422*f*, 422*g*, and 422*h* may be connected to connector, such as elbow connector 428*a* and t-shaped connectors 416*j*, 416*k*, 416*l* and 416*m* via fittings 4201, 420*m*, 420*n*, 420*o* and 420*p* and tubings 426*a*, 426*b*, 426*c*, 426*d* and 426*e*. The t-shaped connectors 416*j*, 416*k*, 416*l* and 416*m* and fittings 4201, 420*m*, 420*n*, 420*o* and 420*p* may be similar to those previously described. The elbow connector 428*a* may be, for example, an SS-16-E fitting available from Swagelok Company. The elbow connector 428*a* and each of the t-shaped connectors 416*j*, 416*k*, 416*l* and 416*m* may be connected to another via fittings 420*q*, 420*r*, 420*s* and 420*t*.

A third pressure gauge 415*c* may, optionally, be disposed between the second pressure relief valve 412*b* and the series of pressure-reducing regulators 408*a*, 408*b*, 408*c*, 408*d* and 408*e*. For example, the third pressure gauge 415*c* may be connected to t-shaped connector 416*o* by fitting 420*u*, elbow connector 428*b* and a reducing bushing 418*c*. A t-shaped valve 416*p* and a reducing bushing 418*d* may connect the second pressure relief valve 412*b*. The second pressure relief valve 412*b* may be, for example, an Anderson Greenwood Series 800 pilot operated pressure relief valve, which is available from Tyco Flow Control. A second temperature gauge 421*b* may, optionally, be disposed between the second pressure relief valve 412*b* and the pressure-reducing regulator 410. As a non-limiting example, the second temperature gauge 421*b* and the pressure-reducing regulator 410 may each be connected to a t-shaped connector 416*q*. A reducing bushing 418*e* and a fitting 420*w* may be used to connect the second temperature gauge 421*b* to the t-shaped connector 416*q*. By way of example and not limitation, the pressure-reducing regulator 410 may have a maximum inlet pressure of about 2,000 psig, an outlet pressure of about 5 psig to about 500 psig and an operating temperature range of from about 29° C. to about 82° C. The pressure-reducing regulator 410 may be, for example, a 627 Series pressure-reducing regulator available from Tescom-Emerson Process Management.

Optionally, the third pressure relief valve 412*c*, a fourth pressure gauge 415*d*, a plug valve 430 and a fifth pressure gauge 415*e* may be included in the system 400. By way of non-limiting example, the third pressure relief valve 412*c* may be connected to the system 400 by way of a t-shaped connector 416*r*, an elbow connector 428*c*, fitting 420*x* and reducing bushing 418*f*. The fourth pressure gauge 415*d* may be in fluid communication with the pressure-reducing regulator 410 and the second pressure release valve 412*b* by way of a t-shaped connector 416*r*. For example, elbow connectors 428*d*, 428*e*, and 428*f*, fittings 420*y* and 420*z*, t-shaped connector 416*s* and reducing bushing 418*g* may connect the fourth pressure gauge 415*d* to the t-shaped connector 416*r*. The plug valve 430 may be connected to the t-shaped connector 416*s* by a fitting 420*aa*. The plug valve 430 may be, for example, a Class-300 XENITH® plug valve, which is available from Xomox Corporation (Cincinnati, Ohio). The fifth pressure gauge 415*e* may be connected to the plug valve 430 by a fitting 420*ab*, a t-shaped connector 416*t* and a reducing bushing 418*h*.

The outlet 414 may comprise a reducing bushing 418*i*, such as that shown in FIG. 4. As a non-limiting example, the outlet 414 may be connected to the fifth pressure gauge 415*e* by fittings 420*ac* and 420*ad*, t-shaped valve 416*u*, and elbow connector 428*g*. Optionally, a close nipple 432 may be connected to the t-shaped connector 416*u*.

Natural gas having a pressure of about 3,000 psig and a temperature of about 15.6° C. (about 60° F.) may be injected in to the system 400 through the inlet 402. The natural gas injected into the system 400 may be obtained, for example, from a storage container (not shown).

The natural gas, or portions thereof, may be passed to the low flow bypass line 424 or to the high flow vortex regulator 406, each of which is in selective fluid communication with the inlet 402. If the pressure of the natural gas in the system 400 exceeds about 3,500 psig, sufficient pressure may be released by the first pressure relief valve 412*a*, such that the pressure of the gas entering the high flow vortex regulator 406 is less than or equal to about 3,000 psig. In the low flow bypass line 424, the natural gas may be directed through the low flow vortex regulator 404 by valve 422*a*. The natural gas exiting the low flow vortex regulator 404 may have a substantially decreased pressure and temperature. For example, the temperature of the gas exiting the low flow vortex regulator 404 may be about −51.1° C. (−60° F.) while the pressure may be from about 150 psig to about 2,000 psig.

The natural gas exiting the low flow vortex regulator 404 may be directed to the high flow vortex regulator 406. The gas exiting the high flow vortex regulator 406 may have a substantially decreased pressure and temperature. For example, the temperature of the gas exiting the low flow vortex regulator 404 may be about −51.1° C. (−60° F.).

The natural gas may be directed from the low flow vortex regulator 404 and the high flow vortex regulator 406 to the series of pressure-reducing regulators 408*a*, 408*b*, 408*c*, 408*d*, and 408*e*. Each of the pressure-reducing regulators of the series of pressure-reducing regulators 408*a*, 408*b*, 408*c*, 408*d*, and 408*e* may be in selective fluid communication with the second pressure relief valve 412*b* and the pressure-reducing regulator 410 by way of the valves 422*a*, 422*b*, 422*c*, 422*d*, and 422*e*. The natural gas exiting the series of pressure-reducing regulators 408*a*, 408*b*, 408*c*, 408*d*, and 408*e* may exhibit a pressure of about 225 psig.

The second pressure relief valve 412*b* may be used to reduce the pressure of the natural gas within the system 400. For example, if the pressure of the natural gas exiting the series of pressure-reducing regulators 408*a*, 408*b*, 408*c*,

408*d*, and 408*e* is greater than about 300 psig, a portion of the natural gas may be release through the second pressure relief valve 412*b*.

The natural gas may then be directed to the pressure-reducing regulator 410 wherein the pressure of the gas is reduced from about 225 psig to about 60 psig. The third pressure relief valve 412*c* may be used to release a portion of the natural gas, for example, if the pressure exceeds about 75 psig. The natural gas may exit the system 400 at a substantially reduced pressure and temperature.

FIG. 5 is a simplified schematic illustration of a natural gas delivery system 500 for transport and delivery of natural gas. The system 500 may include a trailer 502 (FIGS. 5A and 5B), a self-propelled vehicle 503 (FIG. 5C) or a stationary unit 505 (FIG. 5D), a storage box 504, hose reels 506, a storage assembly 508, a control cabinet 512 and a pressure reduction system (not shown) for reducing pressure of natural gas, such as those described with respect to FIGS. 1-4, may be adapted for mounting on or connecting to the trailer 502. A manifold of the trailer 502 may include a heat exchanger 514, which is disposed on or connected to the trailer 502. The system 500 may be configured to reduce the pressure of compressed natural gas (CNG) having a pressure of about 3,000 psig to about 45 psig while maintaining an operating temperature of greater than about −40° C. to prevent components of the system 500 from freezing. The reduced pressure natural gas may be injected into a gas distribution line at a temperature of about −28.9° C. (about −20° F.). For example, such a system may be mounted or disposed on a wall, a support or a floor of the trailer 502.

The hose reels 504, or other suitable device, may be used to store hose for connecting an outlet of the system 500 to the gas distribution line. The storage assembly 508 may be configured to hold storage containers for storing the compressed natural gas. For example, the storage containers may be steel cylinders or bottles 516 in selective fluid communication with the pressure reduction system by way of connective tubing 518. The control cabinet 512 may include controls for operating the pressure reduction system. The system 500 may further include monitoring equipment 520 (FIG. 5D), such as, sensors, computers, and the like, for monitoring the pressure, temperature, flow rate, and the like, of the natural gas at different points of the pressure-reducing system. Such monitoring equipment 520 is well known in the art and is, thus, not described in detail herein.

Figure 6:
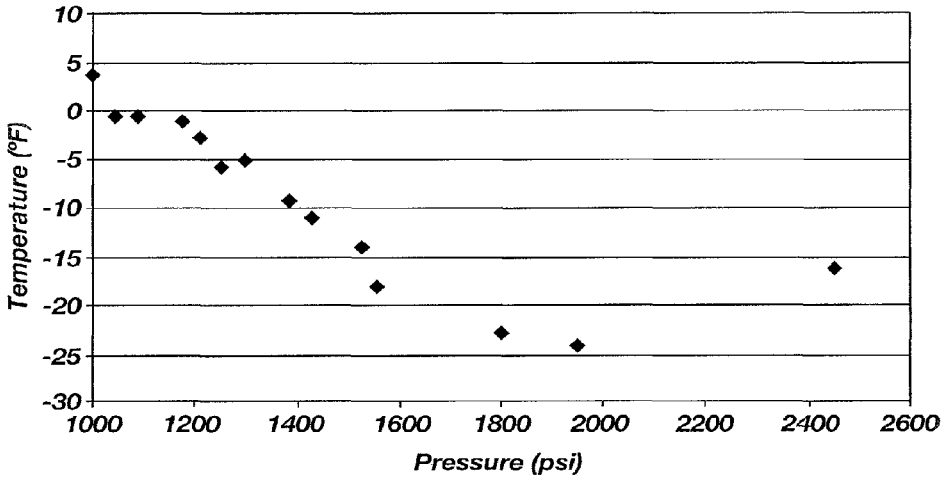
FIG. 6 is a plot of a temperature of the gas released from a low flow vortex regulator (outlet temperature) versus the recorded pressure drop (psi) at a constant flow over a four-hour period of time.

FIG. 6 is a plot of a temperature of the gas released from a high flow vortex regulator (outlet temperature) versus a change in pressure (psig) of the gas (ΔP). The change in pressure was determined by subtracting the pressure of the gas entering the high flow vortex regulator from the pressure of the gas exiting the high flow vortex regulator. As shown in FIG. 6, the outlet temperature of the gas is substantially reduced as the change in pressure increases.

Figure 7:
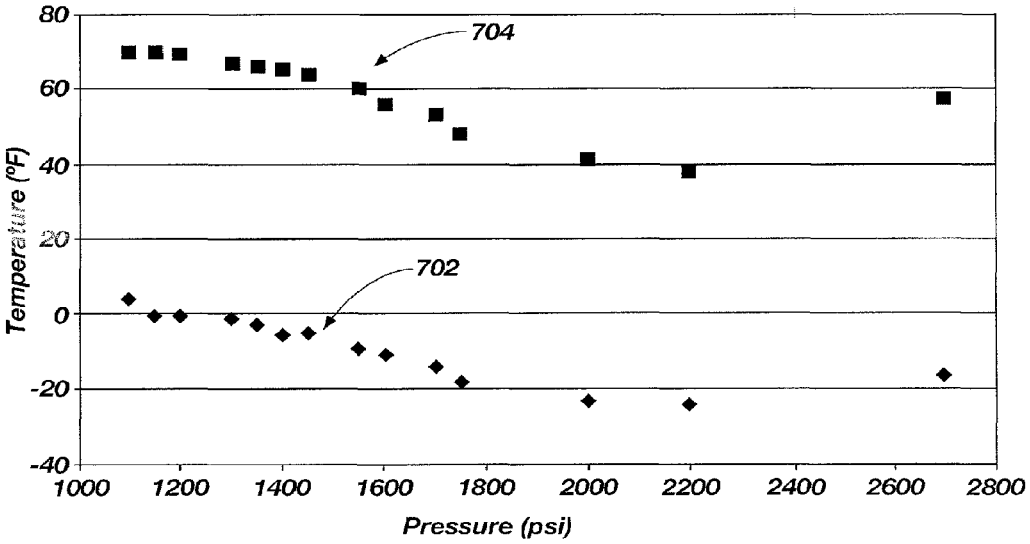
FIG. 7 is a plot of a temperature of gas exiting a vortex pressure regulator and a temperature of gas exiting an ambient heater versus a pressure of gas entering a system such as that described with respect to FIG. 1.

FIG. 7 is a plot of a temperature of gas exiting a vortex pressure regulator 702 and a temperature of gas exiting an ambient heater 704 versus a pressure of gas entering a system such as that described with respect to FIG. 1.

Figure 8:
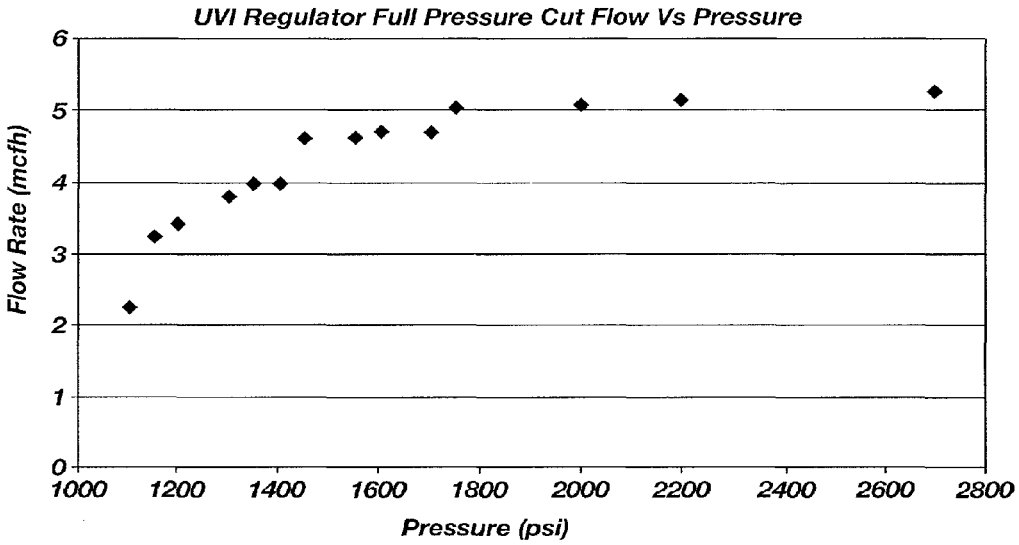
FIG. 8 is a plot of a pressure of gas stored in a storage tank as the pressure of the natural gas is reduced by the vortex pressure regulator at various flow rates in a system similar to that described with respect to FIG. 1.

FIG. 8 is a plot of a pressure of gas stored in a storage tank as the pressure of the natural gas is reduced by the vortex pressure regulator at various flow rates in a system such as that described with respect to FIG. 1. As shown in FIG. 8, the flow rate may be held at about 4,500 mscfh during pressure reduction by the vortex pressure regulator with only a differential change in tank pressure.

Figure 9:
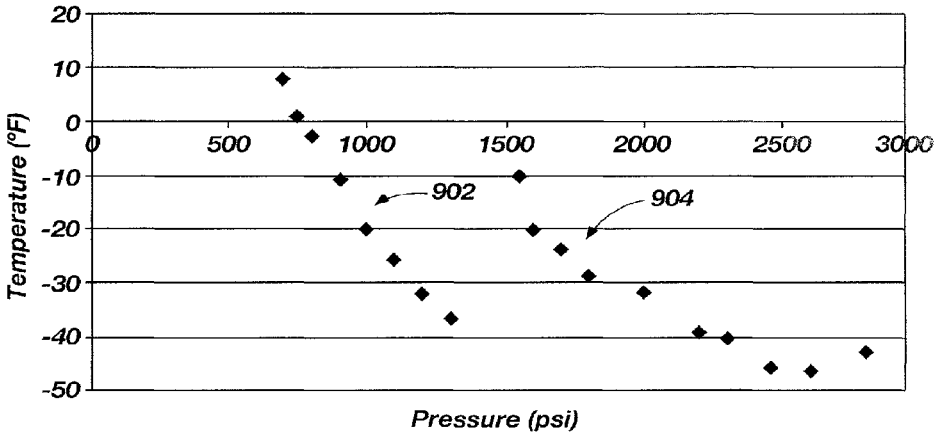
FIG. 9 includes plots of pressure versus temperature of the natural gas after pressure reduction by the second regulator and the vortex pressure regulator in a system similar to that described with respect to FIG. 1.

FIG. 9 includes plots of pressure versus temperature of the natural gas after pressure reduction by the second regulator 122 and the vortex regulator 118 in the system 100 shown in FIG. 1. The second regulator 122 was a 44-1300 Series high flow/high pressure-reducing regulator. The plot 902 corresponds to the pressure versus temperature for the natural gas exiting the second regulator 122 while the plot 904 corresponds to the pressure versus temperature for the natural gas exiting the vortex regulator 118.

Figure 10:
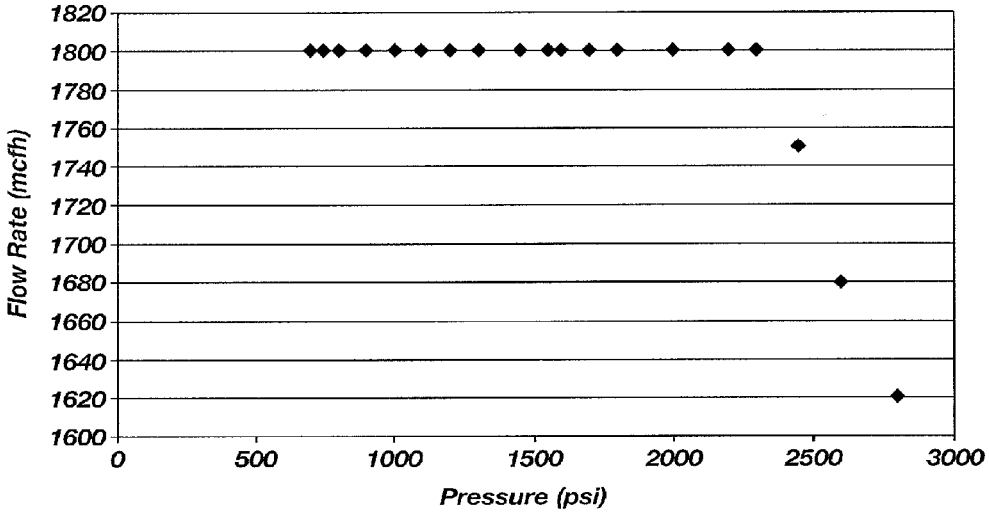
FIG. 10 is a plot of pressure versus flow rate of the gas exiting a high flow/high pressure-reducing regulator used as the second regulator of a system similar to that described with respect to FIG. 1.

FIG. 10 is a plot of pressure versus flow rate of the gas exiting a 44-1300 Series high flow/high pressure-reducing regulator used as the second regulator 122 of a system 100 similar to that shown in FIG. 1.

Figure 11:
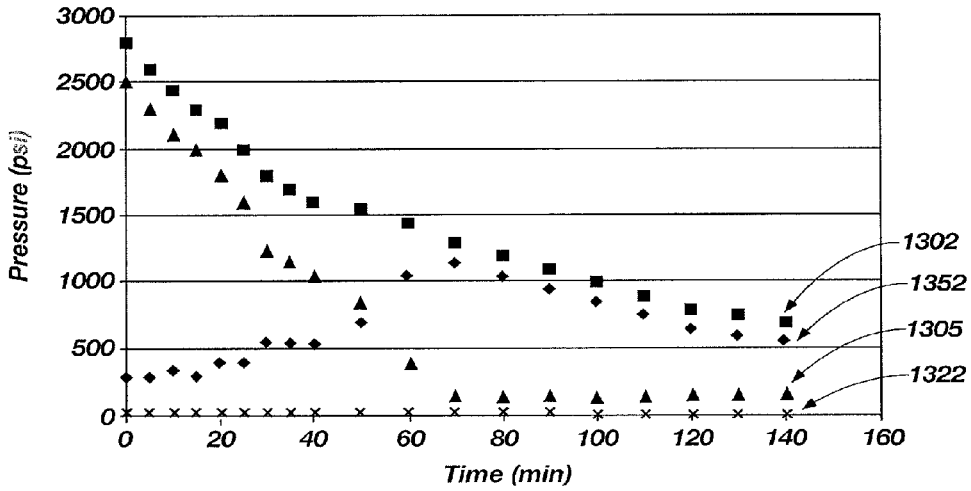
FIG. 11 is a plot of time versus pressure at various points in a system for reducing pressure of natural gas similar to that described with respect to FIG. 3C.

FIG. 11 includes plots of time versus pressure at various points in a system for reducing a pressure of natural gas similar to that shown in FIG. 3C. The pressure of the natural gas was determined at an inlet of the system 1302 and an outlet of a vortex regulator 1352 at various times. The difference in pressure from the second heater inlet 350 of the vortex regulator 1352 to the second heater outlet 352 of the vortex pressure regulator 1305 was also determined. The system 1302 included a TESCOM 44-1300 as the second regulator 1322, which was set at a static pressure of 45 psig. As shown in FIG. 11, as the change pressure by the vortex pressure regulator 1305 approaches the inlet pressure of the natural gas into the system 1302, the vortex pressure regulator 1305 may provide substantially all of the pressure reduction, which enables a broader range of pressure control by the system 1302.

What is claimed is:

1. A system for reducing a pressure of a gas, comprising:

a first regulator valve;

at least one vortex regulator connected to the first regulator valve, the at least one vortex regulator comprising a vortex tube and having at least one inlet to receive natural gas and at least one outlet for releasing the natural gas at a substantially decreased pressure and temperature;

a first heat exchange device configured to receive the natural gas from the at least one vortex regulator and to increase the temperature of the natural gas;

a second regulator valve, the second regulator valve comprising a pressure-reducing regulator in fluid communication with the first heat exchange device and configured for further reducing the pressure of the natural gas and communication with the natural gas;

a second heat exchange device configured to receive the natural gas from the second regulator valve and to increase the temperature of the natural gas; and a bypass line connected upstream of the at least one vortex regulator and downstream of the at least one vortex regulator to allow natural gas to the at least one vortex regulator.

2. The system of claim 1, wherein the first regulator valve comprises a valve in dynamic fluid communication with an inlet of the at least one vortex regulator and configured to reduce a pressure of the natural gas to from about 3,000 psig to about 1,000 psig and to control flow at the at least one vortex regulator.

3. The system of claim 1, wherein the at least one vortex regulator is configured a to reduce a pressure of the natural gas from about 2,500 psig to about 150 psig.

4. The system of claim 2, further comprising a bypass line to direct the natural gas around the at least one vortex regulator.

5. The system of claim 1, further comprising a mobile support comprising the at least one vortex regulator, the first heat exchange device and the second regulator valve.

6. The system of claim 1, wherein the heat exchanger is configured to receive an entirety of the natural gas released from the at least one vortex regulator.

7. The system of claim 1, wherein the heat exchange device is configured to increase the temperature of the natural gas from about −67.8° C. to about −28.9° C.

8. The system of claim 1, wherein the second regulator valve is configured for reducing the pressure of the natural gas to about 30-45 psig.

9. The system of claim 1, further comprising a pulse dampener connected to the second regulator valve.

10. The system of claim 1, further comprising a line disposed between the second regulator valve and a third regulator valve.

11. The system of claim 10, further comprising a pulse dampener between the second regulator valve and the third regulator valve.

12. The system of claim 1, wherein the first regulator valve comprises a spring-loaded diaphragm type valve.

13. The system of claim 10, wherein the third regulator valve comprises a spring-loaded diaphragm-type valve that sets an outlet pressure of the second regulator valve.

14. The system of claim 1, wherein the second regulator valve comprises a pressure-loaded diaphragm-type valve.

15. The system of claim 1, further comprising:

a line connected to an inlet line to the system; and a pulse dampener connected to the line and a third regulator valve.

16. A method of reducing a pressure of natural gas, the method comprising:

directing a natural gas stream into at least one vortex regulator comprising an inlet configured to receive the natural gas, a vortex tube and an outlet configured to release the natural gas;

reducing a pressure and a temperature of the natural gas stream using the at least one vortex regulator;

heating the natural gas stream from the at least one vortex regulator using a heat exchanger in fluid communication with the at least one vortex regulator;

directing the natural gas stream from the heat exchanger to a pressure-reducing regulator to further reduce the pressure thereof; and controlling the pressure of the pressure-reducing regulator using the pressure of the natural gas stream, the pressure-reducing regulator connected by a pressure line to the natural gas stream upstream of the at least one vortex regulator.

17. The method of claim 16, wherein reducing a pressure and a temperature of the natural gas stream using the at least one vortex regulator comprises reducing the pressure of the natural gas steam to about 150 psig and the temperature of the natural gas stream to about −67.8° C.

18. The method of claim 16, further comprising reducing the pressure of the natural gas stream by less than or equal to about 2,000 psig by directing the natural gas stream through at least another pressure-reducing regulator before feeding the natural gas stream into the at least one vortex regulator, thereby controlling the at least one vortex regulator.

19. The method of claim 16, wherein directing the natural gas stream from the heat exchanger to a pressure-reducing regulator to further reduce the pressure thereof comprises reducing the pressure of the natural gas stream to about 45 psig using the pressure-reducing regulator.

20. The method of claim 16, wherein heating the natural gas stream from the at least one vortex regulator using a heat exchanger in fluid communication with the at least one vortex regulator comprises heating the natural gas stream to a temperature of at least about −28.9° C.

21. The method of claim 16, further comprising dampening pressure fluctuations in the pressure of the natural gas stream to the pressure-reducing regulator.

22. A device for delivering natural gas, comprising:

a support;

at least one storage vessel for containing the natural gas in a compressed form disposed on the support;

a first regulator valve in fluid communication with the at least one storage vessel and controlling a flow of the natural gas;

at least one vortex regulator in fluid communication with the at least one storage vessel;

a first heat exchanger in fluid communication with the at least one vortex regulator, the first heat exchanger configured for exchanging heat between the natural gas and a fluid in communication with a surface of the first heat exchanger;

a pressure regulator in fluid communication with the heat exchanger, the pressure regulator controlling the pressure of the natural gas; and a second heat exchanger in fluid communication with the pressure regulator, the second heat exchanger configured to exchange heat between the natural gas and a fluid in communication with a surface of the second heat exchanger; and a bypass line connected upstream of the at least one vortex regulator and downstream of the at least one vortex regulator to allow natural gas to bypass the at least one vortex regulator.

23. The stationary unit of claim 22, wherein the at least one vortex regulator is configured to reduce a pressure of the natural gas from greater than about 2,000 psig to less than about 150 psig.

24. The stationary unit of claim 22, wherein the at least one vortex regulator is configured to reduce a temperature of the natural gas to less than about −67.8° C.

25. The stationary unit of claim 22, wherein the support comprises a trailer configured for holding the at least one storage vessel.

26. The stationary unit of claim 22, further comprising a pressure regulator in fluid communication with the at least one vortex regulator, the pressure regulator configured for reducing the pressure of the natural gas by about 2,000 psig.

27. The stationary unit of claim 22, wherein vortex regulator is configured for reducing pressure from about 2,500 psig to 150 psig.

* * * * *